US006145197A

United States Patent [19]

Kitashima et al.

[11] Patent Number: 6,145,197

[45] Date of Patent: Nov. 14, 2000

[54] METHOD OF ASSEMBLING A GRAND PIANO

[75] Inventors: Riichi Kitashima; Yutaka Nakao; Manabu Arimori, all of Shizuoka-ken, Japan

[73] Assignee: Kabushiki Kaisha Kawai Gakki Seisakusho, Shizouka, Japan

[21] Appl. No.: 08/973,964

[22] PCT Filed: Apr. 18, 1997

[86] PCT No.: PCT/JP97/01353

§ 371 Date: Dec. 15, 1997

§ 102(e) Date: Dec. 15, 1997

[87] PCT Pub. No.: WO97/40490

PCT Pub. Date: Oct. 30, 1997

[30] Foreign Application Priority Data

| | | | |
|---|---|---|---|
| Apr. 19, 1996 | [JP] | Japan | 8-122532 |
| May 24, 1996 | [JP] | Japan | 8-153075 |
| Jun. 4, 1996 | [JP] | Japan | 8-163586 |

[51] Int. Cl.[7] ..... G10C 3/12

[52] U.S. Cl. ..... 29/896.22; 84/177; 84/438

[58] Field of Search ..... 29/896.22; 84/174, 84/177, 187, 438

[56] References Cited

FOREIGN PATENT DOCUMENTS

| | | |
|---|---|---|
| 50-46120 | 4/1975 | Japan . |
| 51-95106 | 8/1976 | Japan . |
| 52-11326 | 1/1977 | Japan . |
| 53-19215 | 2/1978 | Japan . |
| 53-39030 | 4/1978 | Japan . |
| 53-39031 | 4/1978 | Japan . |
| 59-189691 | 12/1984 | Japan . |

*Primary Examiner*—P. W. Echols

*Attorney, Agent, or Firm*—Evenson, McKeown, Edwards & Lenahan, P.L.L.C.

[57] ABSTRACT

A method of assembling a grand piano, an outer rim for a grand piano and a manufacturing method thereof, an arm for a grand piano and a fabricating method thereof, and a keyboard musical instrument are provided. The method of assembling a grand piano comprises an outer rim forming step of forming an outer rim, and a part mounting step of mounting to the outer rim, as a base, a plurality of other parts in order to assemble a grand piano. The outer rim of the grand piano is composed of a left flat plate forming a left front linear portion of a grand piano, a right flat plate forming a right front linear portion of the grand piano, and a plurality of arcuate plates mutually having the same radius r, wherein the arcuate plates are joined to connect rear ends of the left flat plate and the right flat plate therethrough to form a curved portion of the grand piano. The arm for a grand piano comprises an arm portion formed in a front end portion of the outer rim and having a predetermined shape matching the arm of the grand piano, and an arm plate 1 having a shape matching the arm portion of the outer rim and fixed to the arm portion. A keyslip of the grand piano is formed with dowels normal to the surface, while the keybed arranged below the outer rim is formed in a front surface thereof with inserting holes for inserting the dowels of the keyslip thereinto. Also, a receiving fitting is arranged in the inserting hole f or sandwiching a dowel when it is inserted thereinto.

19 Claims, 23 Drawing Sheets

(a)

(b)

(a)

(b)

(a)

(b)

METHOD OF ASSEMBLING A GRAND PIANO

TECHNICAL FIELD

The present invention relates to a method of assembling a grand piano, an outer rim for a grand piano and a manufacturing method thereof, an arm for a grand piano and fabricating method thereof, and a keyboard musical instrument.

BACKGROUND ART

FIGS. 22–24 illustrate the structure of a conventional grand piano, and FIG. 21 illustrates a process of assembling the same. Conventionally, a grand piano is generally assembled in accordance with the following procedure:

A. First, a backpost 1, an inner rim 2, a back beam 3, and so on are "tenoned together" to assemble a backpost assembly 4.

B. After the top surface of the inner rim 2 is formed with a curved plane and grooves for accommodating sound ribs therein, a sound board 8 having sound ribs 6 and bridges 7 (a long bridge 7*a* and a short bridge 7*b*) previously mounted thereon is adhered to the top surface of the inner rim 2. Subsequently, the outer periphery of the adhered sound board 8 is ground for reshaping such that the outer periphery of the sound board 8 matches the outer periphery of the inner rim 2.

C. A pin block 9 and a plate 12 are once placed on the sound board 8 for defining the height of the bridges. Specifically, a bridge height line is drawn on side surfaces of the respective bridges using a previously provided jig, and top surfaces of the bridges are ground to the bridge height line to define a predetermined bridge height.

D. After defining the bridge height, the plate 12 and the pin block 9 are removed, and each of the bridges 7 is cut to form recesses in the top surface thereof for carrying strings thereon, and the lengths of vibrating portions of the strings are defined. In parallel, the removed plate 12 is painted, and hitch pins 14 and agraffe 15 are mounted on the plate 12.

E. A previously formed outer rim 10 is adhered to the outer periphery of the inner rim 2 of the backpost assembly 4. The outer rim 10 is made, for example, of a laminated plate having a total of 15 layers of lauan plywood and decorative single plates of makore adhered to the top and rear surfaces of the lauan plywood laminate. These lauan plywood and decorative single pates are laminated and inserted between an outer mold and an inner mold of a pressing machine, wherein they are pressurized, adhered, and formed into a shape matching the configuration of the inner rim 2.

F. Next, the frontage dimension of the outer rim 10, i.e., the dimension between the inner surfaces of the left and right front ends of the inner rim 2 is adjusted. Specifically, if the frontage dimension, with the outer rim 10 attached thereto, is smaller than a predetermined dimension, the inner surfaces of the inner rims 2 are cut to adjust the frontage dimension.

G. The inner rim 2 and the outer rim 10 are formed with arms at left and right front portions thereof. Specifically, the left and right front portions of the inner rim 2 and the outer rim 10 are respectively cut so as to match predetermined shapes of the respective arms.

H. Next, a decorative single plate (not shown) is glued on each cut surface, and the surfaces of the outer rim 10 and the inner rim 2 including the decorative single plates are spray-painted by a spray gun (base painting).

I. A previously formed and painted keybed 11 is fixed on the lower surface of the outer rim 10 between the left and right ends of the outer rim 10.

J. A pin block 9 is fixed between the left and right front ends of the inner rim 2 of the backpost assembly 4. The plate 12 is also fixed to the backpost assembly 4 in a state in which the plate 12 is carried on the sound board 8 and the pin block 9. Subsequently, after tuning pins 13 are embedded into the pin block 9 through the plate 12, strings S are stretched between the tuning pins 13 and the hitch pins 14 through the bridges 7.

K. Next, a vertical bosom space (the vertical distance from the top surface of the keybed 11 to a string securing points of the strings S) is measured, and the top surface of the keybed 11 is cut for adjustment to define a predetermined dimension of the vertical bosom space. The measurement and adjustment of the vertical bosom space are made using a large keybed cutting machine having a sensor.

L. Large leg blocks 17 and small leg blocks 18 are mounted in order, and then legs 19 and pedals 20 are mounted.

M. Next, a damper unit 21 is mounted to a back beam 3 of the backpost assembly 4, and a keyframe 25 having a keyboard 22, an action 23, and a hammer head 24 previously set thereon is incorporated into the keybed 11, followed by adjustments which are made therefor.

N. Finally, a keyslip 26, cheekblocks 27, a topboard rear 28, a topboard front 29, and so on, i.e., casing parts 30 other than the outer rim 10 are all mounted in place (mounting of parts after the outer rim is formed). Then, the assembly undergoes inspections including finished sound tuning, check for external appearance, and so on. Thus, the assembly of the piano is completed.

Conventionally, the outer rim of a grand piano is integrally formed so as to define the configuration of the grand piano. Such an outer rim is made of a laminated plate composed of approximately 15 layers, for example, including a plurality of single plates of lauan and decorative single plates of birch or makore placed on front and rear surfaces, approximately having a total length of 4–6 meters, a width of 30 centimeters, and a thickness of 4 millimeters. Such an outer rim is generally manufactured in the following steps (A1)–(A3).

(A1) First, for each of single plates, an expert manually curves the plate while it is exposed to a vapor (a single plate forming step).

(A2) Next, the single plates are inserted into an outer mold and an inner mold of a large pressing machine, pressed and adhered to adjacent ones. In this way, the plates are formed into a shape matching the configuration of an inner rim having the configuration of a grand piano (a pressing step).

(A3) Next, after mounted to the inner rim, the laminated plates are repeatedly spray-painted by a spray gun to complete an outer rim (a painting step).

FIG. 25 illustrates a conventional arm for a piano and a fabricating method thereof. An arm 100 is fabricated by adhering a continuous single outer rim 105 along the outer periphery of an inner rim 107 having the configuration of a grand piano, and performing the following processing on front end portions of the inner rim 107 and the outer rim 105. The inner rim 107 is made of wood, for example, by stacking thick solid plates of elm, matoa, or the like in a block-like form. The outer rim 105 is made of plywood composed of a laminate of a plurality of single plates of lauan or the like and decorative single plates of birch, makore, or the like. The plywood has been previously curved into a predetermined shape.

(B1) First, as illustrated in FIG. 25(*a*), a music shelf support rail 101 is adhered to an inner surface of a front end portion of the outer rim 105 such that it comes into contact with the top surface of the inner rim 107 and its top surface is coplanar with that of the outer rim 105. The music shelf support rail 101 is made of plywood similar to that of the outer rim 105.

(B2) Next, as illustrated in FIG. 25(*b*), a cutting machine is used to cut the music shelf support rail 101 together with the outer rim 105 and the inner rim 107 into a shape conformal to the design of the arm 100, and a decorative single plate 108 is adhered to the cut surface.

(B3) Then, the surface including the decorative single plate 108 is painted to complete the arm 108 as illustrated in FIG. 25(*c*).

FIG. 26 is a cross-sectional view illustrating a keyslip mounting portion of a keybed in a conventional keyboard musical instrument, for example, a grand piano. As illustrated in FIG. 26, conventionally, at a top surface end of a keybed 11 on which a keyboard is positioned through a keyframe (either not shown), a keyslip 112 is mounted for preventing a player from viewing the bottom surface of the keyboard to provide a fine appearance near the keyboard as well as for abutting to a fallboard (not shown) to cover the keyboard. The keyslip 112 is formed with a plurality of dowels 112*a* on a longitudinal lower surface and with a cheekblock attachment 12*b* on a back surface for engagement with a cheekblock 27. Then, as illustrated in FIG. 26, the dowels 112*a* are inserted into associated dowel inserting holes 13*a* formed in end portions of the top surface of the keybed 11, while the cheekblock attachment 12*b* is engaged with a keyslip stopper 27*a* formed in an end portion of the cheekblock 27. In this way, the keyslip 112 is mounted to an end portion of the top surface of the keybed 11.

FIG. 27 is a cross-sectional view illustrating a keyslip mounting portion on a keybed in another conventional keyboard musical instrument, for example, an upright piano. As illustrated in this FIG. 27, a keyslip block 122*a* is attached on a back surface of a keyslip 122, while a keyslip engaging portion 123*a* is formed in an end portion of a top surface of the keybed 11. Then, the back surface of the keyslip 122 abuts to a front surface 123*b* of the keybed 11, and the keyslip block 122*a* engages with the engaging portion 123*a* of the keybed 11 and is fixed by a screw 121, whereby the keyslip 122 is mounted to the front surface 123*b* of the keybed 11.

On the top surfaces of the keybed 11 and the keyslip block 122*a*, a keyframe 25 is positioned, and a plurality of keys 22 comprising white keys and black keys are positioned above the keyframe 25. Incidentally, a front pin 126 is attached to an end portion of a top surface of the keyframe 25 in order to prevent the keys 22 from vibrating in the width direction.

As mentioned above, in the conventional assembling method, the backpost assembly 4 is positioned as a base, and parts are mounted thereto in order, and predetermined processing and painting are performed for them to assemble a grand piano. In other words, since mounting, processing and so on of parts are directed to the heavy and large backpost assembly 4, except for a portion of separately prepared parts, from the start to the end of assembly, this causes difficulties in handling during the assembly, an increase in scale of machines and facilities for attachment, and so on, thereby incurring a drawback that an assembling cost is increased.

For example, since the outer rim 10 is formed as a single continuous curved plate conformal to the configuration of the inner rim 2 of the backpost assembly 4, a pressing machine therefor is necessarily large. For the same reason, machine tools for forming a curved surface of the inner rim 2, making arms on the outer rim 10 and so on, painting facilities for performing base painting and so on, and other machines are obliged to be also large. Further, since the outer rim 10 is formed of a single curved plate, painting therefor must be performed using a paint having a relatively small flow-out by repeating a spray painting step and a drying step a large number of times so as to prevent the paint from dropping down on the outer rim, thus requiring an extremely long time for the painting step.

Also, in the conventional assembling method, since the backpost assembly 4 is positioned as a base such that most of steps such as mounting and processing of parts are advanced in order, in a so-called serial assembling line, the assembly cannot proceed to a next step unless the previous step is completed. For example, since strings are stretched after the plate 12 is mounted to the backpost assembly 4 and the tuning pins 13 are embedded, the time-consuming step of embedding the tuning pins 13 causes stagnation on the assembling line, resulting in a degraded manufacturing efficiency.

Furthermore, in the conventional assembling method, since the plate 12 is carried on the pin block 9, the thickness of the pin block 9 may directly affect the height at which the strings S are positioned, and hence the bridge height. For this reason, the aforementioned adjustment of the bridge height is required. If the thickness of the pin block 9 is less accurate, the adjustment of the bridge height will require significant labor and time.

In addition, since the plate 12 is mounted and the strings are stretched after the keybed 11 is fixed to the outer rim 10, the tensile forces of the strings S may cause deformations such as bow and twist to the backpost assembly 4 and the outer rim 10 which are made of wood materials. Due to the influence of such deformations, positional relationships between parts, for example, the vertical bosom space, are more susceptible to large shift. On the other hand, since the keybed 11 has already been fixed to the outer rim 10, adjustment of the vertical bosom space will require, for example, a large keybed cutting machine having a sensor for cutting the keybed 10. This also causes an increase in the assembling cost.

The above-mentioned conventional outer rim and manufacturing method thereof have, first of all, a drawback that objects to be processed are large and difficult to handle commonly over all manufacturing steps because of the integrally formed outer rim. Also, since each manufacturing step requires a wider space, a factory or the like must have a wide area, resulting in an increase in facility cost, operation cost and so on of the factory. Further, dedicated machines such as a large pressing machines required for use in the aforementioned (A2) pressing step additionally increases the facility cost.

In addition to the foregoing, in the aforementioned (A1) single plate forming step, since an expert must manually curve, with patient, the large single plate which is difficult to handle, a processing period becomes longer, and accordingly a processing cost is also increased. Further, as mentioned above, not only a large number of materials such as a large dimension single plate are required, but they cannot be used unless they are satisfactorily processed. Frequently occurring processing errors would result in a lower material yield, which constitutes a factor of increasing a processing cost and a material cost.

In the aforementioned (A3) painting step, the conventional method of assembling a grand piano has a problem of a longer painting period, as previously mentioned in relation to the outer rim.

Also in the aforementioned conventional arm and manufacturing method thereof, since the arm 100 is processed for the large and heavy outer rim 105 and inner rim 107, after the outer rim 105 has been adhered to the inner rim 107, i.e., after they have been shaped into the configuration of a grand piano, the facility cost is increased for the reasons mentioned in connection with the aforementioned conventional method of assembling a grand piano. Also, in the painting step, a time required for the painting becomes longer for the reason mentioned above, so that the entire manufacturing period is prolonged.

The keyslip mounting portion of the keybed in the aforementioned keyboard musical instrument has problems as follows when a keyboard, an action and so on are adjusted. Specifically, for adjusting the keyboard, the action and so on in the case of a grand piano, they are generally pulled out in front together with a keyframe, so that the keyslip must be removed from the keybed. However, since the keyslip mounting portion has a structure as illustrated in FIG. 26, the cheekblock 27 must be removed from the top surface of the keybed 11 before the keyslip 112 is removed from the keybed 11. Also, as illustrated in FIG. 26, when the keyslip 112 is mounted to an end portion of the top surface of the keybed 11, the front surface 113*b* of the keybed 11 is also exposed, which is not favorable in an esthetics point of view. Thus, for such a case, a decorative single plate (not shown) must be attached to the front surface 113*b* of the keybed 11 and painted.

For an upright piano, in turn, since the keyslip mounting portion has a structure as illustrated in FIG. 27, it is necessary, for removing the keyslip 122, to first remove the keyframe 25 and the keyboard 22 positioned on the top surface of the keybed 11 and the keyslip block 122*a*, and to next remove the screws 121. For this reason, the removal of the keyslip 112 is complicated.

Disclosure of the Invention

The present invention has been made to solve the problems as mentioned above, and one of its objects is to provide a method of assembling a grand piano which is capable of achieving a significant simplification and an improved efficiency for assembling steps and accordingly a considerable reduction in assembling cost.

Another object of the present invention is to provide a outer rim for a grand piano and a manufacturing method thereof which are capable of reducing a manufacturing period and reducing costs in terms of materials, processing, facilities, and so on.

A further object of the present invention is to provide an arm for a grand piano and a fabricating method thereof which is capable of easily fabricating the arm, thereby reducing a fabricating period, and of reducing costs in terms of processing, facilities and so on.

A further object of the present invention is to provide a keyboard musical instrument which is capable of easily removing a keyslip from a keybed in a grand piano or the like and efficiently adjusting a keyboard, an action and so on.

To achieve the first mentioned object, according to a first aspect of the present invention, there is provided method of assembling a grand piano comprising an outer rim forming step of forming an outer rim, and a part mounting step of mounting the outer rim, as a base, a plurality of parts in order to assemble a grand piano.

According to the method of assembling a grand piano of the first aspect of the present invention, a grand piano is assembled by mounting to an outer rim, as a base, a plurality of other parts in order. Since the outer rim has a lighter weight as compared with a backpost assembly, which is a conventional base part, mounting and processing of the parts are facilitated to improve handling easiness during assembly, thereby making the assembly more easily.

The outer rim forming step preferably comprises an outer rim member forming step of individually forming a plurality of outer rim members, respectively, and an outer rim member joining step of joining the plurality of formed outer rim member to each other.

In this preferred aspect, since the outer rim may be composed of a plurality of divided outer rim members, their formation and processing can be performed in smaller dimensions, as compared with the conventional case where the outer rim is originally formed as a continuous single plate. It is therefore possible to easily and efficiently perform bending processing for single plates constituting the outer rim as well as to employ a pressing machine for forming the outer rim, other machine tools, and so on of smaller dimensions.

The outer rim member forming step preferably comprises an outer rim member painting step of painting the plurality of outer rim members, respectively.

According to this preferred aspect, since the outer rim members are painted during the outer rim forming step, i.e., before they are assembled, smaller painting facilities can be employed, as compared with the conventional method.

More preferably, the plurality of outer rim members are composed of two flat plate constituting front left and right linear portions of the outer rim and a curved plate constituting the remaining portion of the outer rim.

According to this preferred aspect, the two flat plates may be placed, for example, in an even state and coated by a flow coater, thereby facilitating the painting work and reducing a time required therefor.

The part mounting step preferably comprises, as a portion thereof, a sound board unit mounting step of mounting a sound board unit including a sound board to a plurality of sound board bases fixed to an inner surface of the outer rim.

According to this preferred aspect, since the sound board is mounted to the outer rim through the plurality of sound board bases fixed to the inner surface of the outer rim, the conventional inner rim, serving to mount the sound board to the outer rim, is basically unnecessary, leading to a reduction in the number of parts.

Preferably, a predetermined incline is previously formed on a top surface of the sound board base, so that the sound board is fixed to the sound board base in a state in which the sound plate is carried on the incline.

According to this preferred aspect, a predetermined crowned shape is given to the sound board by the incline formed on the top surface of the sound board base. Also, since this incline is previously formed on each sound board base, it can be relatively easily formed using a small machine tool.

Preferably, a reinforcing material is attached on the inner surface of the outer rim.

In this preferred aspect, the outer rim is reinforced by the reinforcing material, so that insufficient strength and rigidity due to the elimination of the inner rim can be compensated to ensure predetermined strength and rigidity of the outer rim.

The sound board of the sound board unit is preferably made of plywood.

According to this preferred aspect, the sound board can be extremely easily manufactured at a low cost, as compared with the conventional sound board which has been manufactured by aligning plates of solid materials and joining them side by side.

The sound board unit preferably comprises a bridge and a sound rib mounted on front and rear surfaces of the sound board, respectively, and the bridge has undergone recess formation and string definition.

According to this preferred aspect, the mounting of the sound rib as well as the recess formation and the string definition can be previously completed before the sound board is mounted to the outer rim. Such promotion of unit formation for the sound board enables the next step, directed to the outer rim, to immediately proceed after the sound board is mounted, thereby improving the efficiency of assembling a piano.

The part mounting step preferably comprises, as a portion thereof, a plate unit mounting step of fixing a plate unit including a plate to the sound board base in a state in which the plate is carried on the sound board after the sound board unit mounting step.

According to this preferred aspect, the plate is also mounted to the outer rim through the sound board bases, so that the conventional inner rim, which has also served to mount the plate, is completely unnecessary.

The plate unit preferably comprises a pin block directly mounted to the plate.

According to this preferred aspect, since the pin block is directly mounted to the plate, the thickness of the pin block will not influence at all the height at which strings are subsequently stretched, and hence a bridge height. As a result, a thickness tolerance of the pin block is alleviated, and a bridge height close to a predetermined bridge height can be attained at the time the plate is mounted to the pin block. Thus, the predetermined bridge height can be attained only by fine adjustment, thereby making it possible to eliminate the conventional laborious bridge height definition by cutting the bridge.

Preferably, a nose bolt is included for adjusting a bridge height by adjusting a vertical relative distance of the plate to the sound board.

According to this preferred aspect, the bridge height can be easily adjusted by rotating the nose bolt to change the vertical distance between the plate and the sound board.

Preferably, a tuning pin is embedded in the pin block of the plate unit.

According to this preferred aspect, since the tuning pin is previously embedded in the pin block as a part of the plate unit, the next step can be immediately entered after the plate unit mounting step, thereby making it possible to efficiently assemble the piano without the time-consuming tuning bin embedding step causing stagnation of the assembling line. In addition, it is also possible to mount hitch pins to the plate to previously arrange strings loosely between those and tuning pins, thereby further promoting the formation of the plate into a unit.

The part mounting step preferably comprises, as a portion thereof, a keybed unit mounting step of stretching strings in the plate, subsequently fixing a keybed base to an inner surface of the outer rim, and mounting a keybed unit including a keybed to the outer rim through the keybed base after the plate unit mounting step.

According to this preferred aspect, since the keybed is mounted to the outer rim after the strings have been stretched in the plate, even if deformations such as bow and twist occur in the outer rim 10 or the like due to the tensile forces of the strings, bad influence due to the deformations can be eliminated by mounting the keybed base to the deformed outer rim at the predetermined height position, thereby making it possible to accurately provide a predetermined vertical bosom space. This results in eliminating the keybed cutting processing using a large cutting machine which has been previously performed for adjusting the vertical bosom space.

The keybed base and the sound board base are preferably mounted at respective predetermined height positions based on the same height reference position of the outer rim.

According to this preferred aspect, only when the keybed base and the sound board base are defined at their respective predetermined height positions based on a height reference position set at a common position of the outer rim, a predetermined value can be attained for a vertical distance between the keybed mounted to the keybed base and the strings stretched in the plate. In other words, a predetermined vertical bosom space can be easily attained.

Preferably, the height reference position is set at a top surface of the outer rim, and the keybed is arranged between inner surfaces of the outer rim.

According to this preferred aspect, since the keybed is arranged between inner surfaces of the inner rim, the keybed can be mounted at an arbitrary vertical position of the outer rim, unlike the conventional case where the keybed is arranged between lower surfaces of the outer rim. It is therefore possible to easily mount the keybed at a predetermined height position basad on the top surface of the outer rim, while absorbing (releasing) deformations or the like of the outer rim.

The keybed unit preferably comprises a damper unit mounted to the keybed.

According to this preferred aspect, the damper unit is formed as a part of the keybed unit to thereby promote the formation of the components into a unit The keybed unit preferably comprises a keyframe carried on the keybed, the keyboard mounted on the keyframe, an action, and a hammer head.

According to this preferred aspect, the keyframe, the keyboard, the action and the hammer head are also formed as parts of the keybed unit to further promote the formation of the parts into a unit. In addition, it is possible to previously complete regulations for the parts including the damper unit. Together with the keybed accurately mounted at a predetermined height position, subsequent regulations can be extremely easily carried out only with slight adjustments.

The part mounting step preferably comprises, as a portion thereof, a keyboard unit mounting step of mounting a keyboard unit including a keyboard to the keybed after the keybed unit mounting step.

According to this preferred aspect, the keyboard unit is assembled separately from the keybed unit, and mounted to the keybed after the keybed unit is mounted to the outer rim.

The keybed unit preferably comprises a keyframe carried on the keybed, the keyboard mounted on the keyframe, an action, and a hammer head.

According to this preferred embodiment, since regulations for portions except for the damper unit can be finished beforehand, subsequent regulations can be easily carried out.

To achieve the secondly mentioned object, according to a second aspect of the present invention, there is provided an outer rim for a grand piano comprising a left flat plate forming a left front linear portion of a grand piano, a right flat plate forming a right front linear portion of the grand piano, and a plurality of arcuate plates mutually having the same radius, the arcuate plates being joined to connect rear ends of the left flat plate and the right flat plate therethrough to form a curved portion of the grand piano.

The outer rim according to the second aspect of the present invention is constructed by joining the left flat plate, the right flat plate and the plurality of arcuate plates. In other words, unlike the integrally formed one, the respective members can be handled independently until immediately before they are joined. In this way, each object to be processed in the manufacturing steps is smaller and easier to handle. In addition, the manufacturing steps for the respective members can be advanced independently and in parallel, thereby making it possible to reduce a manufacturing period. Also, since each manufacturing step requires a less space, a smaller area is sufficient as the whole factory, thereby making it possible to reduce a facility cost and an operation cost for the factory. Further, since a large pressing machine or the like used in a pressing step is not required and a smaller one may be used, the facility cost can be further reduced.

If off-the-shelf laminated plates are used for the left flat plate and the right flat plate of the linear portions, steps of manufacturing laminated plates from single plates (a single plate forming step and a pressing step) are not required, so that a material cost and a processing cost can be reduced. In addition, since a plurality of arcuate plates having the same radius are used as arcuate plates for the curved portion, they can be manufactured by dividing a cylindrical material having that radius in the circumferential direction.

When such a cylindrical material is manufactured as a laminated plate in the factory, formation of simple cylinder is only required, so that manual processing by an expert is eliminated, automation is also facilitated, a processing period is shortened, and the processing cost is reduced. Also, since an outer mold and an inner mold of a used pressing machine may have simple cylindrical shapes, a pressure control during the pressing operation is easier, so that a relatively inexpensive pressing machine may be used, and therefore the facility cost can be reduced.

If cylindrical materials marketed overseas or the like are used, the single plate forming step and the pressing step can be eliminated, so that not only the processing period therefor can be omitted to reduce the entire manufacturing period, but also the material cost and the processing cost can be reduced. Further, since the facility for generating vapor and facilities such as a pressing machine are not necessary, the facility cost can also be reduced.

If steps up to painting are terminated before the respective members are joined, objects to be painted are small, so that painting and drying periods can be reduced in a painting step. Also, in this case, since both the flat plates of the linear portions can be painted in an evenly placed state, a paint having a high flow-out can be used, thereby making it possible to carry out thin and uniform painting. It is therefore possible to reduce the drying time to make the painting period shorter. Further, in this case, since painting techniques for ordinary flat plates such as flow coating may be used, a reduced number of steps and a reduced period can be achieved by automation, thereby making it possible to further reduce the processing cost and the manufacturing period.

To achieve the secondly mentioned object, according to a third aspect of the present invention, there is provided a method of manufacturing an outer rim for a grand piano, comprising a left flat plate manufacturing step of manufacturing a left flat plate forming a left front linear portion of a grand piano, a right flat plate manufacturing step of manufacturing a right flat plate forming a right front linear portion of the grand piano, an arcuate plate manufacturing step of manufacturing a plurality of arcuate plates forming a curved portion of the grand piano, the arcuate plates mutually having the same radius, and a joining step of joining the plurality of arcuate plates to each other to form the curved portion and joining both ends of the curved portion to rear ends of the left flat plate and the right flat plate to manufacture the outer rim for the grand piano.

In the method of manufacturing a grand piano according to the third aspect of the present invention, the joining step can be executed after the left flat plate manufacturing step, the right flat plate manufacturing step, and the arcuate plate manufacturing step have been executed independently of and in parallel with each other, so that it is possible to have similar advantages to those described in connection with the second aspect of the present invention. Particularly, an entire manufacturing period can be reduced.

Preferably, the arcuate plate manufacturing step has a step of dividing a cylindrical material in a circumferential direction to cut a plurality of arcuate plates.

According to this preferred aspect, a cylindrical material may be divided in the circumferential direction to manufacture a plurality of arcuate plates having the same radius, and the plurality of arcuate plates can be used as the arcuate plates of the curved portion. If the cylindrical material can be used, a simple formation of cylinder may only be required, thereby making it possible to eliminate processing of single plates by an expert and to reduce a processing period and a processing cost because of automation and so on. Also, since a relatively inexpensive pressing machine having simple cylindrical outer mold and inner mold may be used, a facility cost can be reduced. Further, if off-the-shelf cylindrical materials are used, a single plate forming step and a pressing step can be omitted, and facilities such as a pressing machine are not necessary, thus making it possible to reduce a manufacturing period as well as to reduce costs in terms of material, processing, facility and so on.

To achieve the thirdly mentioned object, according to a fourth aspect of the present invention, there is provided an arm for a grand piano comprising an arm portion formed in a front end portion of an outer rim and having a predetermined shape matching an arm of the grand piano, and an arm plate having a shape matching the arm portion of the outer rim and fixed to the arm plate.

The arm according to the fourth aspect of the present invention is composed only of the arm portion of the outer rim and the arm plate. Specifically, the arm can be provided, without using an inner rim, only by forming the arm portion of the outer rim conformal to the shape of an arm of a grand piano, forming the arm plate conformal to the shape of this arm portion, and fixing the arm plate to the arm portion. Thus, with this arm, processing may be separately performed on smaller and lighter arm plates instead of a large and heavy inner rim integrated with an outer rim, so that they are correspondingly easier to handle, easier to process, and easier to fabricate.

Preferably, the outer rim is composed of a plurality of plates including a flat plate constituting the front linear portion of the outer rim.

According to this preferred aspect, since the left and right front linear portions of the outer rim, for example, are formed of flat plates, the arm portions are formed in front end portions of the flat plates. For this arm, small, light and flat plates may only be processed separately, instead of the conventional large, heavy and curved outer rim in its entirety, so that the arm can be more easily fabricated.

To achieve the thirdly mentioned object, according to a fifth aspect of the present invention, there is provided a method of fabricating an arm for a grand piano comprising: an arm portion forming step of forming an arm portion of a predetermined shape matching an arm of a grand piano in a front end portion of an outer rim, an arm plate forming step of forming an arm plate having a shape matching the arm portion of the outer rim, and an arm forming step of mounting the arm plate to the arm portion of the outer rim to form the arm for a grand piano.

In this fabricating method, an arm is fabricated by mounting to an arm portion formed in a front end portion of an outer rim, an arm plate having a shape matching the arm portion. Thus, in this fabricating method, processing and so on may be performed for a small and light arm plate instead of processing for a large and heavy inner rim, the processing and so on are correspondingly facilitated, and a processing cost can be reduced. Also, since the arm plate forming step can be executed independently of and in parallel with the outer rim arm portion forming step, a fabricating period can be reduced. Further, if the arm portion of the outer rim is formed in a flat state, for example, before the outer rim is curved conformal to the configuration of a grand piano, a large-scale cutting machine is not required either, so that the facility cost can be reduced.

Preferably, the arm portion forming step has an arm portion painting step of painting the arm portion, and the arm plate forming step has an arm plate painting step of painting the arm plate.

In this preferred aspect, the fabrication of the arm portion of the outer rim and the arm plate can be performed independently and in parallel up to the painting steps, so that the fabricating period can be further reduced. Particularly, since the arm plate is a small object to be painted and easy to handle, a painting and drying time in the painting step can be reduced. Also, since the flat arm plate can be painted in a horizontally placed state, a paint having a high flow-out can be used, so that thin and uniform painting is possible, thereby making it possible to reduce a drying time and hence reduce a painting period. Further, in this case, since painting techniques for ordinary flat plates such as flow coating may be used, a reduced number of steps and a reduced period can be achieved by automation, thereby making it possible to further reduce the processing cost and the fabricating period.

Preferably, the outer rim is composed of a plurality of plates including a flat plate constituting a front linear portion of the outer rim, and the arm portion is formed in a front end portion of the flat plate in the arm portion forming step.

According to this preferred aspect, the arm portion is formed in a front end portion of a flat plate forming a front linear portion of the outer rim. In this case, since cutting, painting and so on can be performed only for a small, light and flat plate, the advantages described above in connection with the arm plate can be similarly produced. In comparison with an outer rim which is integrally formed as a whole, a reduced processing cost and a shorter fabricating period can be attained.

To achieve the fourthly mentioned object, according to a sixth aspect of the present invention, there is provided a keyboard musical instrument comprising a keyslip provided with a plurality of protrusions on a back surface thereof, and a keybed provided with inserting holes for the protrusions in a front surface thereof, wherein the protrusions are inserted into the inserting holes to mount the keyslip to the keybed in an abutting state.

According to the keyboard musical instrument of the sixth embodiment of the present invention, since the protrusions are formed on the back surface of the keyslip, while the inserting holes for inserting the protrusions are formed in the front surface of the keybed to which the keyslip is mounted, the protrusions are inserted into the inserting holes to bring the back surface of the keyslip into contact with the front surface of the keybed, whereby the keyslip can be easily mounted to the keybed. In addition, the keyslip can be easily removed from the keybed without removing a cheekblock or a keyframe.

Preferably, locking means is provided in the inserting holes for locking the protrusion.

According to this preferred aspect, since the locking means for locking the protrusion is provided in the inserting hole to enable the keyslip to be held only with the locking means, the size of the inserting hole can be made sufficiently larger than the size of the protrusion. Therefore, when the keyslip is to be mounted to the keybed, the protrusions can be easily inserted into the inserting holes without accurate alignment of the protrusions to the inserting holes. In addition, since a dimensional accuracy is not required for forming the inserting holes in the keybed, the inserting holes are easily formed and processed. Further, by holding the protrusions in the inserting holes with the locking means in the inserting holes, the keyslip can be reliably kept mounted to the keybed.

BEST MODE FOR CARRYING OUT THE INVENTION

The preferred embodiment of the present invention will hereinafter be described in detail with reference to the drawings.

Figure 1:
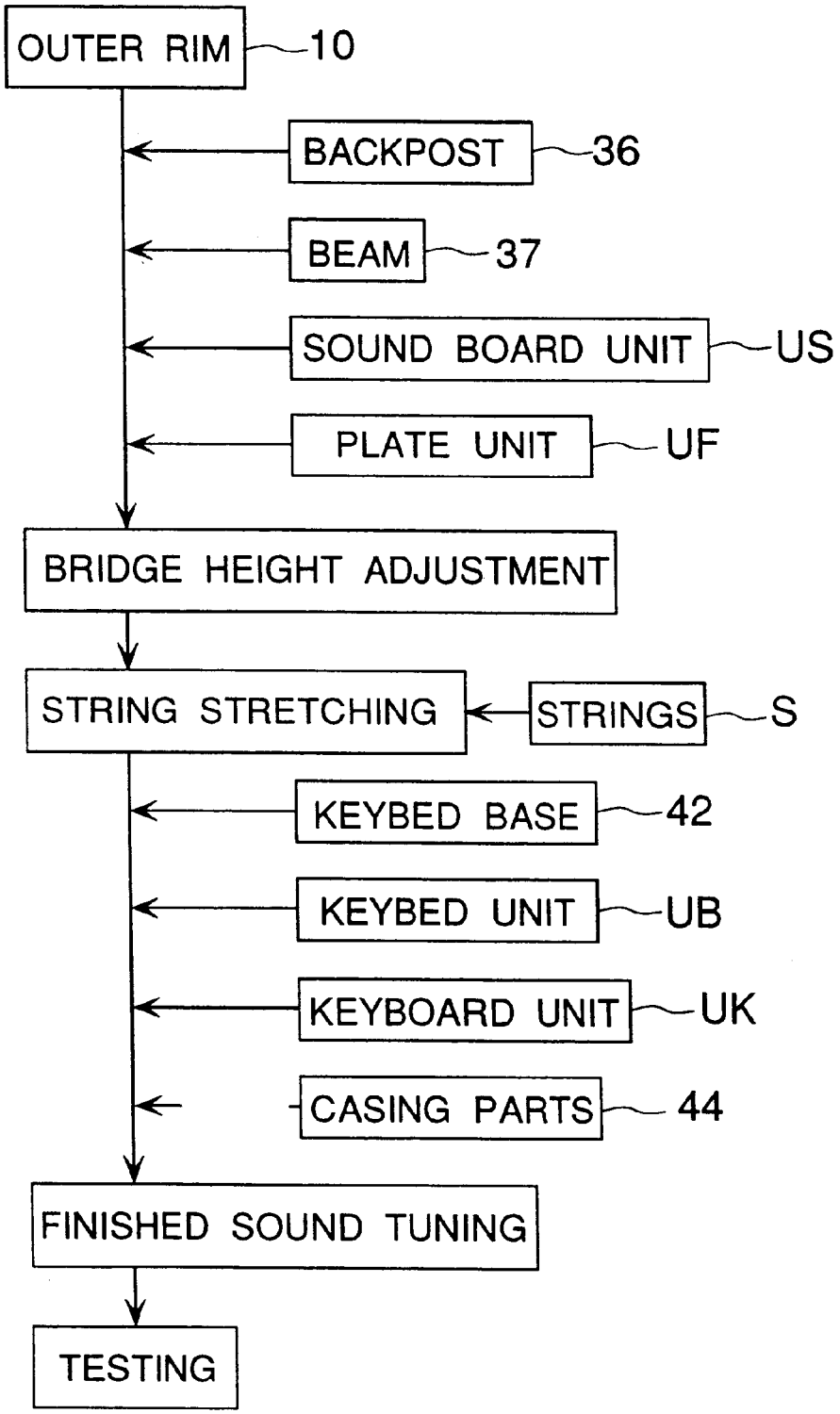
FIG. 1 is a flow diagram generally illustrating a method of assembling a grand piano according to a first embodiment of the present invention.

FIG. 1 illustrates principal assembling steps of a grand piano to which the present invention is applied. As illustrated in FIG. 1, this ground piano eliminates a conventionally used inner rim and is assembled by directly mounting to an outer rim 10, as a base, a sound board unit US, a plate unit UF, strings S, a keybed unit UB, and a keyboard unit UK in order. In the following, a method of assembling this grand piano will be described in detail in the order of steps. In the following description, parts common to constituent parts in the previously described FIGS. 21–27 are designated using common reference numerals.

1. Outer Rim Forming Step

The outer rim 10 is made of plywood composed of a laminate of a plurality of single plates of lauan or the like and decorative single plates of birch, makore, or the like, and consists of three segments: a left flat plate 10*a* constituting a left front linear portion, a right flat plate 10*c* constituting a right front linear portion, and a curved plate 10*b* constituting a rear curved portion. In accordance with such a divided structure, the respective flat plates 10*a*, 10*c* do not require bending processing, while the curved plate 10*b* only may undergo the bending processing for the respective single plates and lamination by a small pressing machine, thereby making it possible to easily manufacture them at a low cost.

Figure 2:
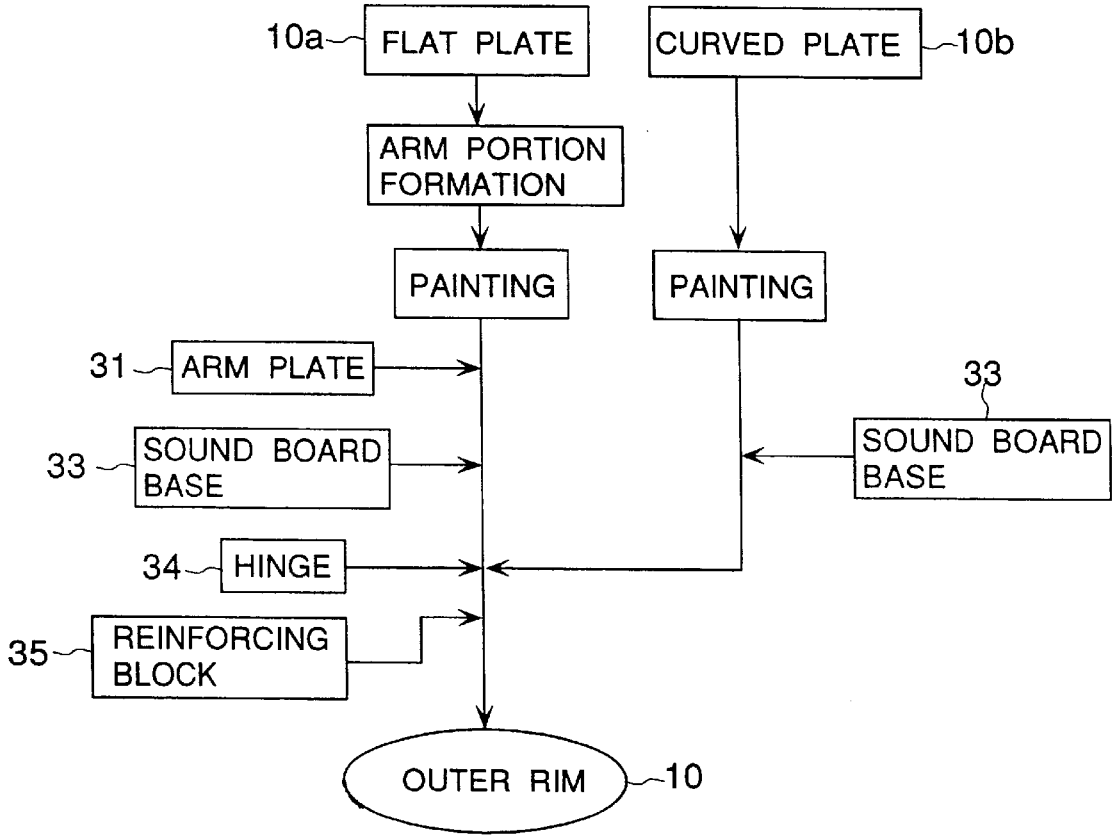
FIG. 2 is a flow diagram illustrating the structure of an outer rim and a assembling procedure.

The outer rim 10 is assembled in a procedure illustrated in FIG. 2 using the flat plates 10*a*, 10*c* and the curved plate 10*b* formed as mentioned above. Specifically, the curved plate 10*b* is first spray-painted by a spray gun or the like. In this event, since the curved plate 10 subjected to the painting is smaller than a conventional continuous solid outer rim, the painting may be performed with a smaller spray gun.

As to the flat plates 10*a*, 10*c*, on the other hand, front end portions of the respective flat plates 10*a*, 10*c* are cut to form arm portions 10*c* in a predetermined shape, and then they are painted. The painting can utilize a flow coater since the flat plate 10*a*, 10*c* are flat. For example, the flat plates 10*a*, 10*c*, placed in an even state, are moved to pass through a curtain of a paint having a high flow-out, and light drying with ultraviolet rays or the like is used in combination, thereby making it possible to easily complete the painting and the drying in a shorter time.

Figure 4:
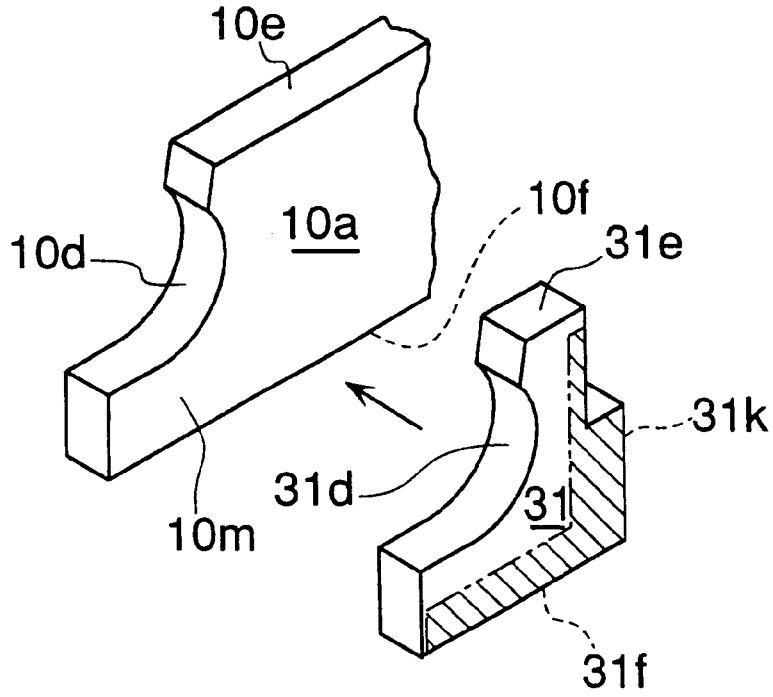
FIG. 4 is an explanatory diagram of an arm and a fabricating method thereof.
Figure 4:
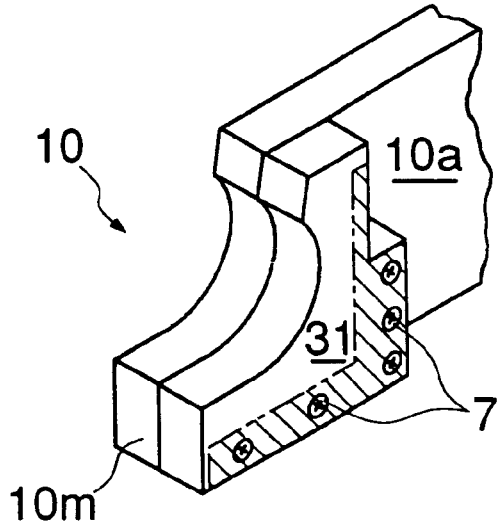

Next, as illustrated in FIG. 4, separately formed and painted arm plates 31 in the same shape are each adhered to and secured with screws to the inner surface of an arm portion 10*m* of the front end portion of each of the flat plates 10*a*, 10*c*, thus completing the processing of the arm 32. The arm plate 31 may also be painted in the same manner as the aforementioned flat plates 10*a*, 10*c*.

Figure 3:
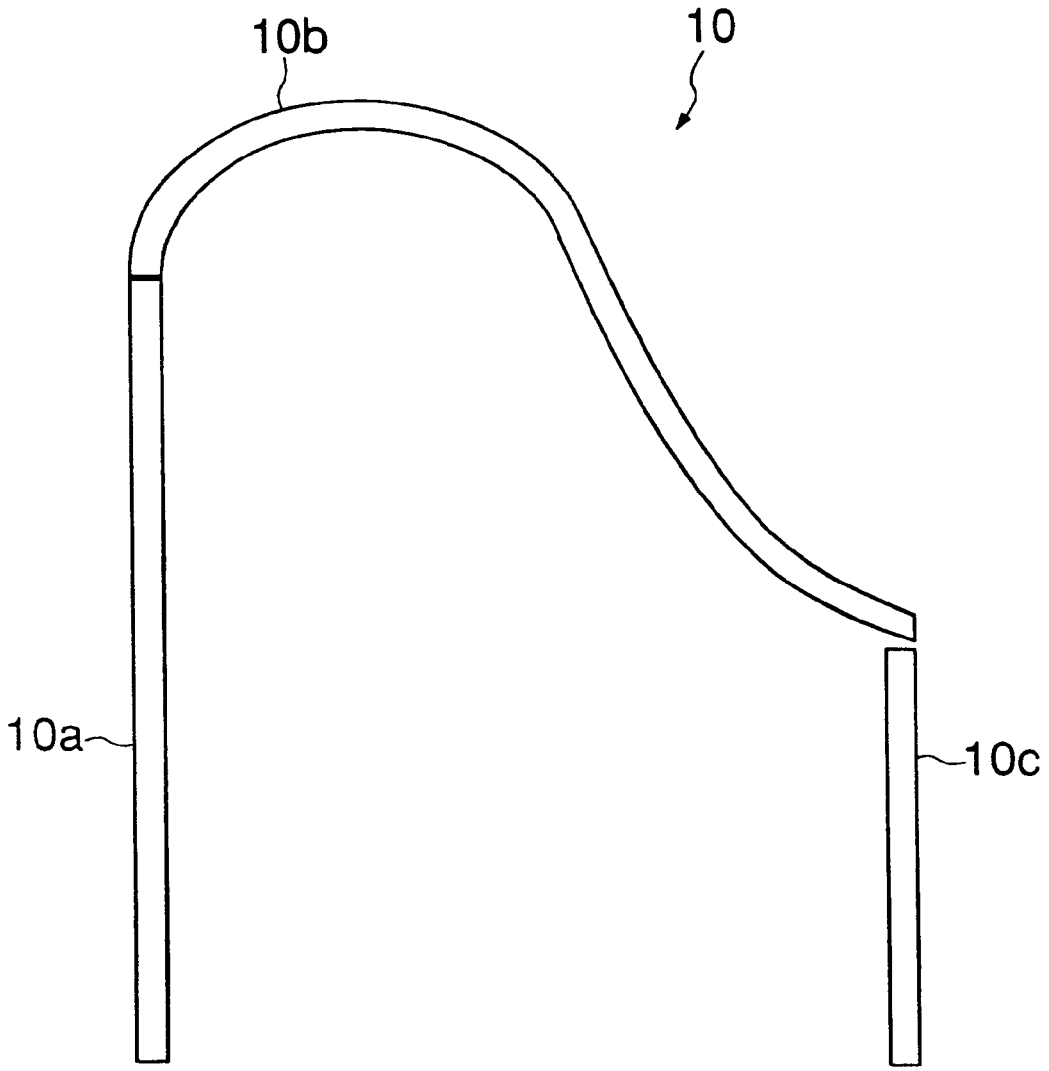
FIG. 3 is a plan view of the outer rim.

Here, the arm for use in a grand piano and a fabricating method thereof, in accordance with the present invention, will be described in greater details with reference to FIGS. 3 and 4.

FIG. 4(*b*) illustrates an arm 32 proximal to the left flat plate 10*a*. This arm 32, which is formed in a front end portion of the left flat plate 10*a*, is composed of an arm portion 10*m* having a shape along the design of the arm 32, and an arm plate 31 having a shape conformal to the arm portion 10*m* of the left flat plate 10*a* and fixed to the arm portion 10*m*. The arm plate 31 is made of plywood similar to that of the outer rim 10.

Specifically, for example as illustrated in FIG. 4(*a*), a front end surface 10*d* of the arm portion 10*i* of the left flat plate 10*a* comprises a central curved surface portion and flat surface portions on upper and lower sides thereof, so as to form part of the front end surface of the arm 32, while an upper end surface 10*e* and a lower end surface 10*f* comprise flat surfaces, respectively. The arm plate 31 is formed such that an upper end surface 31*e* and a lower end surface 31*f* are coplanar with respective corresponding surfaces of the arm portion 10*m* of the left flat plate 10*a*, i.e., the front end surface 10*d*, the upper end surface 10*e*, and the lower end surface 10*f*. In this case, the lower end portion and the rear end portion are invisible sites hidden inside the grand piano (hatched portions in FIG. 4). Also, a rear end surface 31*k* has its lower end protruding such that it may be easily fixed by screws or the like.

The arm 32 having the foregoing structure is fabricated in accordance with the following steps.

(1) Arm Portion Forming Step

First, the arm portion 10*m* of the aforementioned shape is formed by cutting a front end portion of the left flat plate 10*a* having a predetermined shape and length with a cutting machine. Then, after the cut surface is finished by adhering a decorative single plate (not shown) or the like thereto, the surface is painted by flow coating (an arm painting step) to complete the arm portion 10*m*. The flow coating may be performed using a painting machine such as a flow coater. In this event, the left flat plate 10*a* is carried on a conveyer or the like and passed through a paint curtain of a paint having a high flow-out, and the applied paint is dried by ultraviolet rays or the like and instantaneously hardened, so that the painting step can be terminated in a short time.

(2) Arm Plate Forming Step

The arm plate 31 is fabricating by forming it into the aforementioned shape conformal to the arm portion 10*m* in a manner similar to the left flat plate 10*a*, and painting the surface of the arm portion 10*m* by flow coating (the arm plate painting step). This step is performed independently of and in parallel with (1) Arm Portion Forming Step.

(3) Arm Forming Step

Next, the arm plate 1 formed as described above is mounted to the inner surface of the arm portion 10*m* of the left flat plate 10*a* with screws 7 or an adhesive such that the respective corresponding surfaces are coplanar to each other, as illustrated in FIG. 4(*b*). As a result, the arm 32 on the left side, composed of the arm portion 10*m* of the left flat plate 10*a* and the arm plate 31, is completed.

For a right flat plate 3, in turn, a right arm 32 is fabricated in a similar manner. After fabricating both arms 32, the curved plate 10*b* is joined to rear end surfaces of the respective left flat plate 10*a* and right flat plate 10*b* to assemble the outer rim 10 (see FIG. 3), and mounted as the outer rim 10 of the grand piano (see FIG. 22). In this event, the lower end and the rear end of the arm plate 31 are formed so as to be hidden inside the grand piano, thus providing the arm 32 free of sense of incompatibility in terms of external appearance.

As described above, the arm 32 is composed only of the arm portion 10*m* of the left flat plate 10*a* or the right flat plate 10*c* of the outer rim 10 and the arm plate 31. Therefore, the arm 32 and the fabricating method thereof only require the separate processing of the small and light arm plate 31, left flat plate 10*a*, and right flat plate 10*c*, instead of processing the large and heavy outer rim and inner rim as an integrated part, i.e., cutting front end surfaces, attaching decorative laminate materials, and so on. Therefore, the processing is correspondingly easier, thereby allowing for a shorter fabricating period and a reduced processing cost. In addition, since a large-scaled cutting machine and a machine for adhering a decorative single plate are not necessary, the facility cost can also be reduced.

Also, since the steps up to the painting are performed before respective members are joined, painted parts are small, so that a painting and drying time in the painting step can be reduced, and large-scaled painting facilities are not required either, thereby making it possible to further reduce costs of processing, facilities and so on. Also in this case, since the arm plate 31, the left flat plate 10*a*, and the right flat plate 10*c* can be painted in a horizontally placed state, a paint having a high flow-out can be used, so that thin and even painting can be achieved. In addition, automated painting utilizing a painting technique such as flow coating mentioned above provides a reduction in the number of steps and a shortened painting period, so that a further reduction in the processing cost and a shorter fabricating period can be achieved. Further, a material cost can also be reduced by utilizing off-the-shelf plywood for the arm plate 31, the left flat plate 10*a* and the right flat plate 10*c*.

As described above, since the arm plate 31 is small and easy to handle, the arm can be fabricated more easily even with an integrally formed outer rim similar to the conventional one, instead of an outer rim made up of divided members as the aforementioned outer rim 10. For example, the arm portion of the outer rim may be formed while the outer rim is in a flat state before it is curved conformal to the configuration of the grand piano. In this way, the arm can be formed only by mounting the arm plate 31 on the inner surface of the arm portion of the outer rim even without using the inner rim. Therefore, the cutting or the like for a large and heavy inner rim, as has been performed in the prior art, is not required, thereby making it possible to reduce a fabricating period as well as a reduction in cost associated with the processing and facilities.

Furthermore, a variety of modifications are possible without limited to the foregoing embodiment. For example, the hatched portions of the arm plate 31 in FIG. 4 may be partially omitted to be smaller, lighter, and easier to handle, or decorative single plates for the arm portion 10*m* and the arm plate 31 may be omitted to reduce the material cost. Also, while the arm 32 in FIG. 4 is assembled after the arm plate 31 and the left flat plate 10*a* have been separately painted, they may be painted or decorative single plates may be adhered, by way of example, after they have been assembled into the arm 32 because neither the arm plate 31 nor the left flat plate 10*a* is a large member.

Turning back to the description on the assembling steps of the grand piano, next, a sound board base 33 is adhered to and screwed to the respective inner surfaces of the flat plates 10*a*, 10*c* and the curved plate 10*b*. The sound board base 33, which serves as a basis for subsequently attaching a sound board 8 and a plate 12, is positioned and mounted at a predetermined position a predetermined distance below the top surface of the flat plates 10*a*, 10*c* and the curved plate 10*b* which is defined as a height reference position. The sound board base 33 is made of a rod-like wood material and has an outer surface of a shape conformal to the inner surfaces of the flat plates 10*a*, 10*c* and the curved plate 10*b* such that the sound board base 33 can be tightly fitted to them. In addition, the sound board base 33 is previously formed at the top surface thereof with an incline 33*a* for giving a predetermined crowned shape to the sound board 33. In this way, since the individual sound board base 33 undergoes the incline formation, this incline formation can be easily performed as compared with the conventionally performed curved surface formation for an inner rim of a large backpost assembly.

Figure 5:
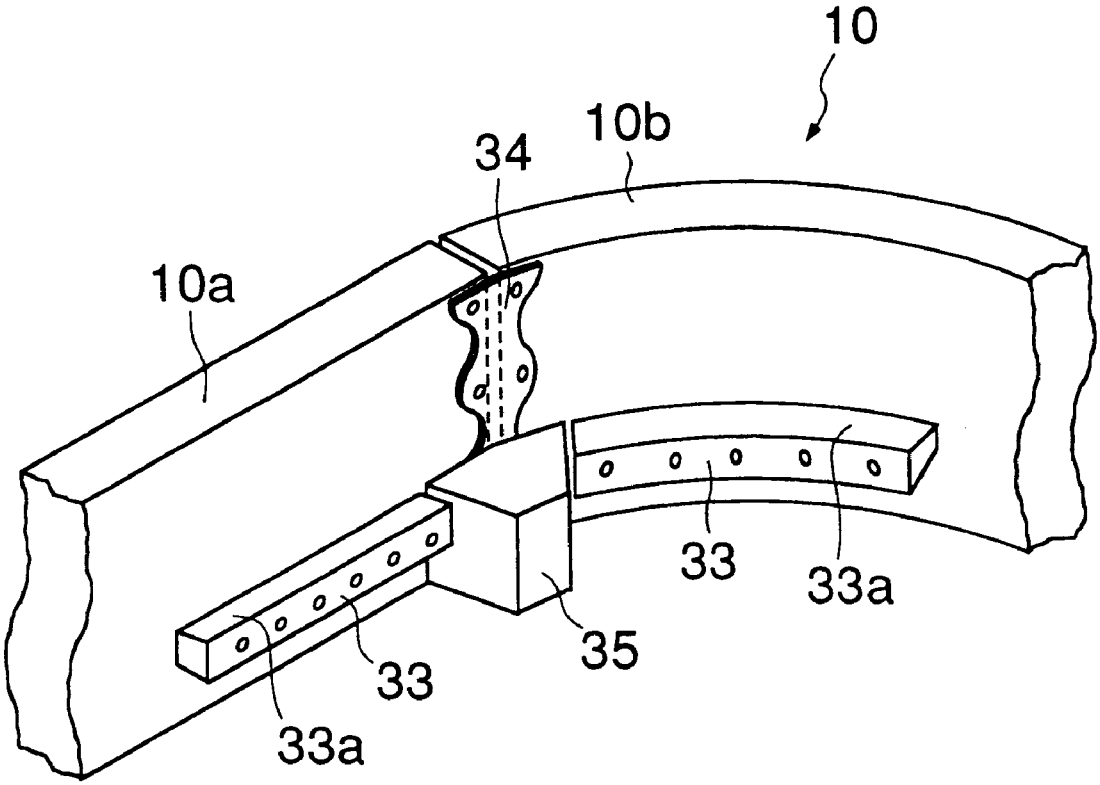
FIG. 5 is a perspective view illustrating the structure of a joint of an outer rim.

Next, as illustrated in FIG. 5, the two flat plates 10*a*, 10*c* and the curved plate 10*b* are joined together through a hinge 34 and a reinforcing block (reinforcing material) 35 to form the outer rim 10. The hinge 34 is made of a metal and screwed to an upper portion of each of joints of the flat plate 10*a*, 10*c* and the curved plate 10*b* to connect both the plates 10*a*, 10*b*. In addition, the hinge 34 is formed in a corrugated shape to provide a decorative effect.

The reinforcing block 35 in turn is made of a wood material, and positioned below the hinge 34 to be coplanar with the top surface of the sound board base 33, and adhered to this position for reinforcing insufficient strength and rigidity due to elimination of the inner rim to ensure a predetermined strength and rigidity for the outer rim 10 as well as to function as a mounting member for the sound board 8 together with the sound board base 33.

2. Backpost and Beam Mounting Step

Figure 6:
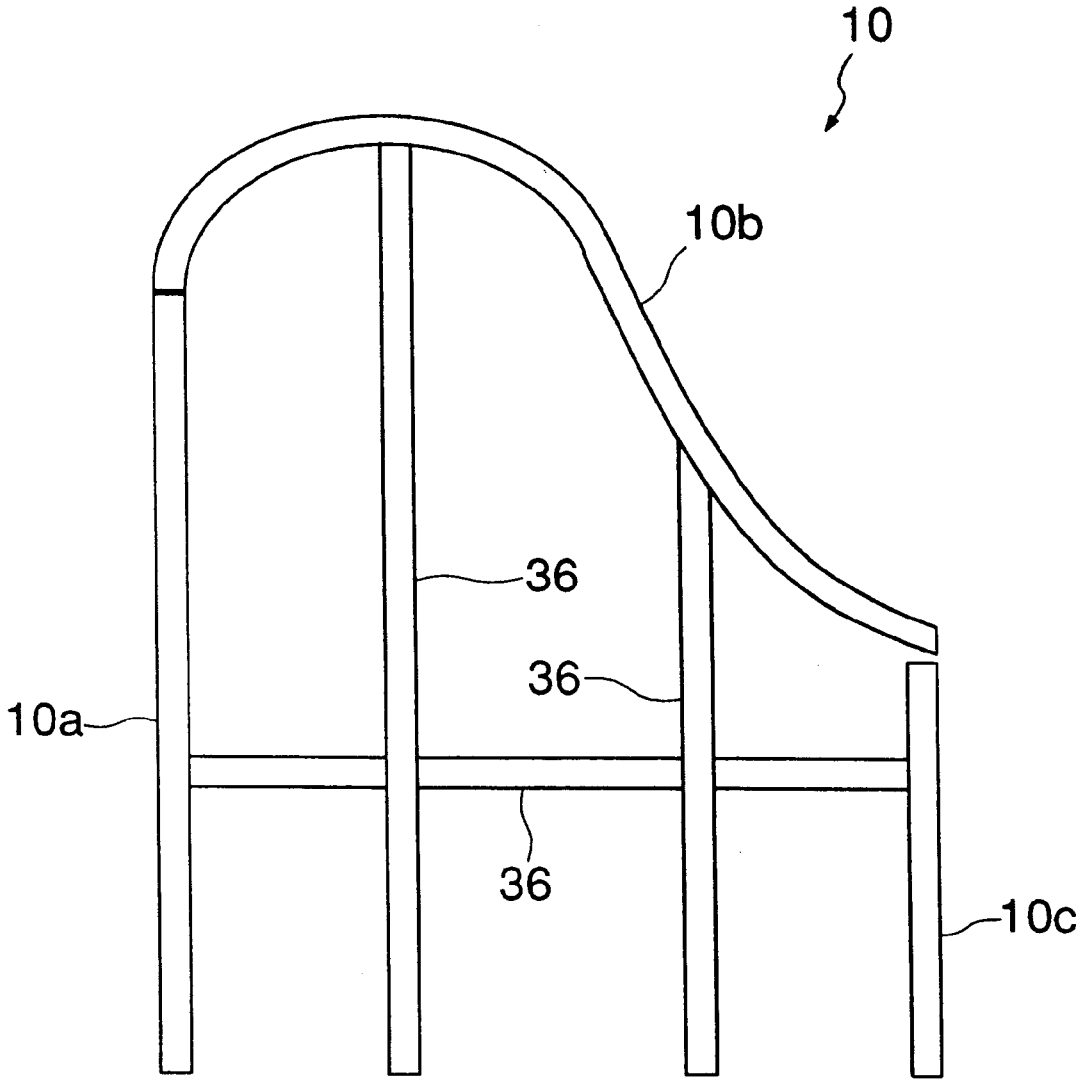
FIG. 6 is a plan view illustrating the outer rim and a backpost.

Next, backposts 36 and beams 37 such as a back beam are mounted to the outer rim 10 formed as described above (see FIG. 1). These backposts 36 and the beams 37 serve less as conventional strength members and principally function as mounting members for associated parts such as nose bolts and leg blocks 19, later described. For this reason, the backposts 36 are positioned unlike the conventional backpost 1, as illustrated in FIG. 6. That is, two are positioned in parallel in the vertical direction and one is positioned in the horizontal direction. In addition, its thickness is smaller than that of the conventional backpost 1.

The backposts 36 and the beams 37 are mounted to the outer rim 10 using a connecting fitting 38 illustrated in FIG.

Figure 7:
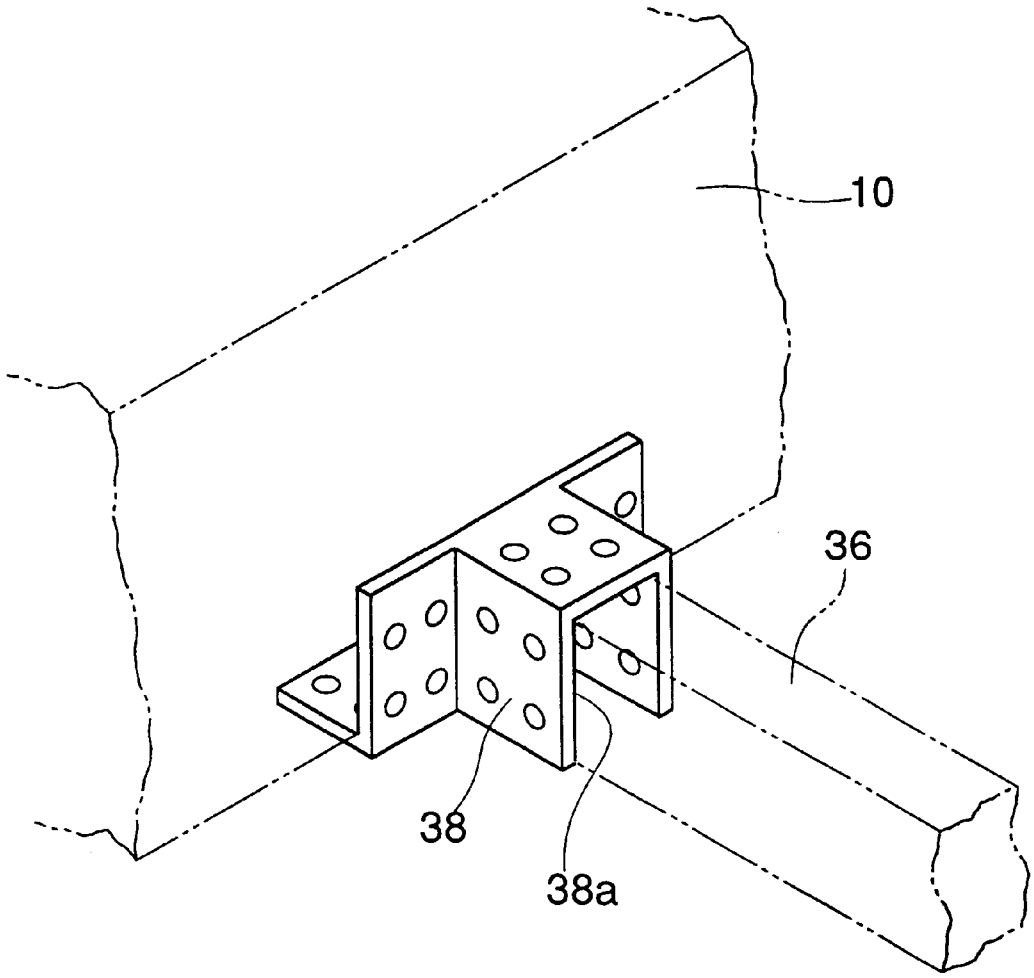
FIG. 7 is a perspective view illustrating how the backpost is mounted to the outer rim.

7. As illustrated in FIG. 7, the connecting fitting 38 is arranged at a predetermined position in a lower portion of the outer rim 10 and screwed from two directions including the inward and lower directions. The backpost 36 is inserted into a fitting hole 38*a* of the connecting fitting 38 and screwed from three directions. Thus, the backposts 36 and the beams 37 can be accurately and securely mounted easily to the outer rim without tenon.

3. Sound Board Unit Mounting Step

Figure 8:
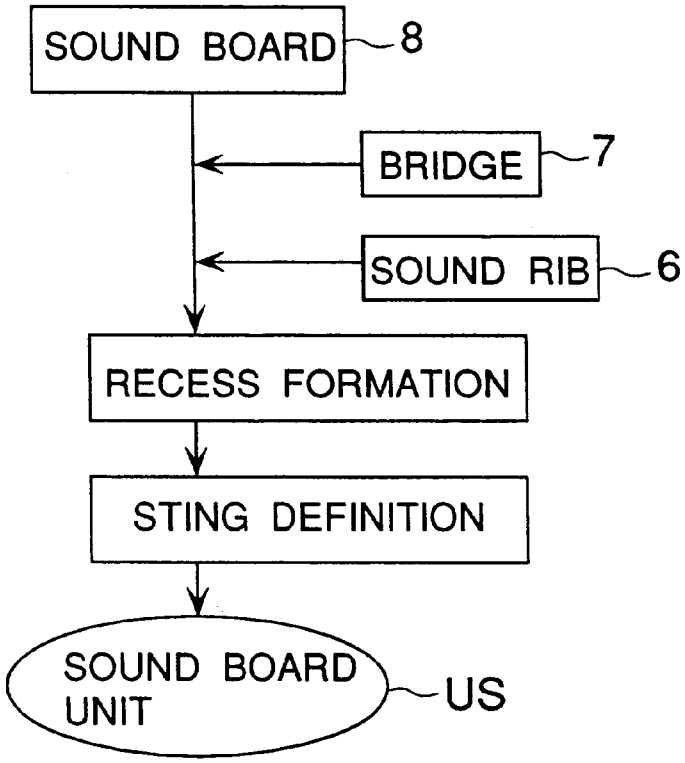
FIG. 8 is a flow diagram illustrating the structure of a sound board unit and an assembling procedure.
Figure 9:
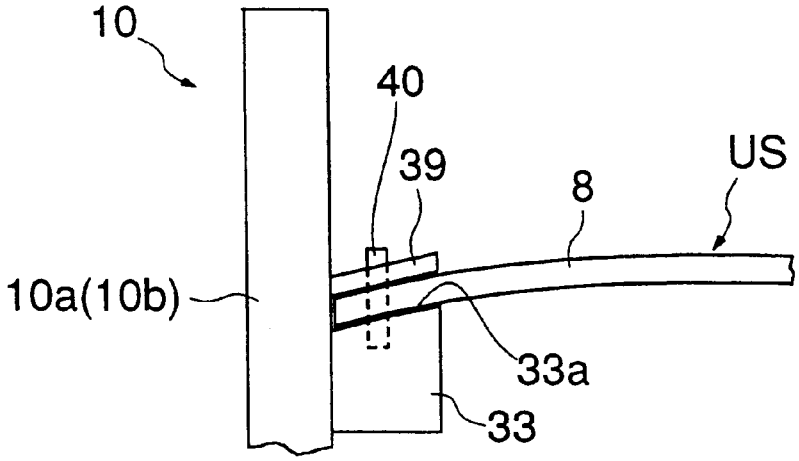
FIG. 9 is a front view illustrating how the sound board unit is mounted to the outer rim.

Next, the sound board unit US is mounted to the outer rim 10 through the sound board base 33. As illustrated in FIG. 8, this sound board unit US is in a state where bridges (a long bridge and a short bridge) 7 are adhered to the surface of the sound board 8, a sound rib 6 is adhered to the rear surf ace of the sound board 8, and recess formation as well as string definition have been completed. The sound plate 8 is formed in a predetermined shape matching the inner periphery of the outer rim 10 by taking two sheets from one sheet of off-the-shelf plywood and cutting the outer peripheries of the two sheets. Thus, in comparison with the conventional sound board manufactured by aligning plates of solid material and joining them side by side, the sound board 8 can be significantly simply manufactured at a low cost. In addition, since the sound rib 6 is arranged on the sound board 8 except for a peripheral portion thereof, the sound board 8 can be mounted to the sound board base 33 without forming a groove in the sound board base 33.

The sound board unit US formed as described above is mounted to the outer rim 10 by implanting a tacker 40 into the sound board 8, with its peripheral portion carried on the incline of the sound board base 33, through a sound board fixture 39. The sound board fixture 39 presses the sound plate 8 to prevent it from coming up as well as functions to hide a gap between the sound board 8 and the outer rim 10. In accordance with this structure, a predetermined crowned shape can be given to the sound board 8 by the incline of the sound board base 33, and since the sound board base 33 is positioned at the aforementioned predetermined height position, the sound board 8 can be accurately positioned at the predetermined height position.

4. Plate Unit Mounting Step

Figure 10:
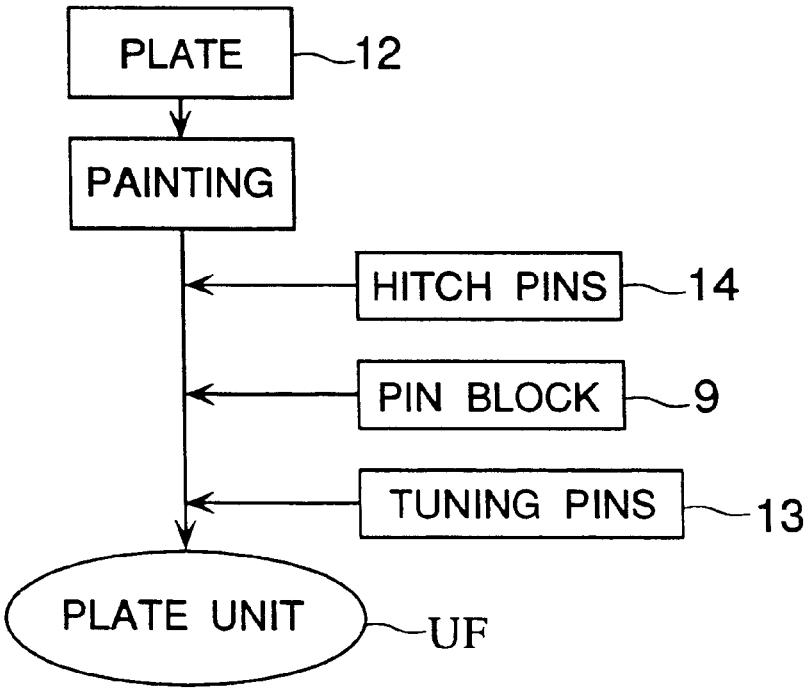
FIG. 10 is a flow diagram illustrating the structure of a plate unit and an assembling procedure.
Figure 11:
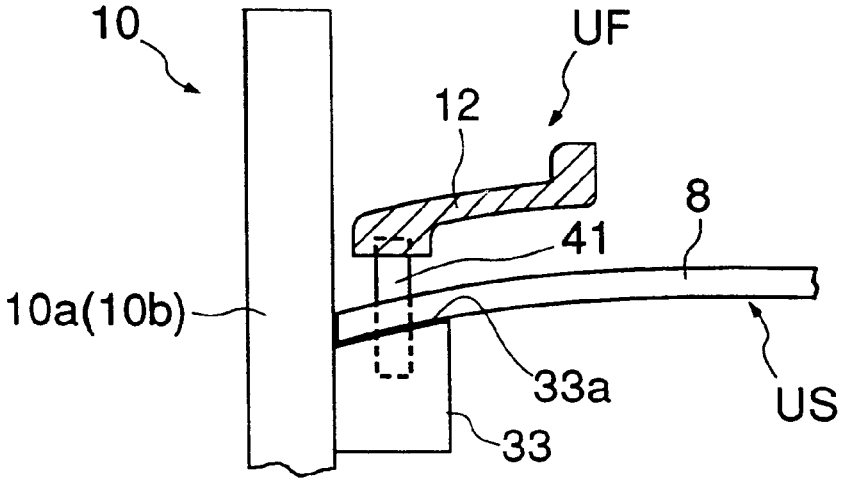
FIG. 11 is a front view illustrating how the plate unit is mounted to the outer rim.

Next, the plate unit UF is mounted to the outer rim 10 through the sound board base 33. As illustrated in FIG. 10, this sound board unit UF is fabricated by first painting a plate 12 integrally casted in a predetermined shape, implanting a hitch pin 14, mounting a pin block 9, and embedding a tuning pin 13 into the pin block 9. The conventionally used agraffe is eliminated, so that the lengths of the strings S are regulated only by capo d'astro bar (not shown). The plate unit UF is mounted to the outer rim 10 by securing the plate 12 to the sound board base 33 with screws (not shown), with a peripheral portion of the plate 12 carried on the sound plate 8, as illustrated in FIG. 11. In this event, a dowel 41 is used for positioning in the horizontal direction.

In this way, since the pin block 9 is directly mounted to the plate 12, the thickness of the pin block 9 exerts less influence to the height at which the strings S are subsequently stretched in the plate 12 and hence to the height of the bridges. As a result, the thickness tolerance of the pin block. 9 is alleviated, and a bridge height close to a predetermined bridge height can be attained at the time the plate is mounted to the pin block 9. Thus, the predetermined bridge height can be attained only by fine adjustment, thereby eliminating the conventional laborious bridge height definition by cutting the bridge. This bridge height adjustment may be easily made by rotating a nose bolt (not shown), arranged between the plate 12 and the backpost 36 and extending through the sound board 8, to change the height of the plate 12.

Also, since the tuning pin 13 has been previously embedded in the pin block 9 as a part of the plate unit UF, the next step can be immediately entered after the plate unit mounting step, thereby making it possible to efficiently assemble the piano without the time-consuming tuning bin 13 embedding step causing stagnation of the assembling line.

5. String Stretching Step

Next, a string S is rolled and stretched with a predetermined tensile force between the tuning pin 13 and the hitch pin 14 of the plate 12 through the bridge 7. Alternatively, the strings S may be previously attached to the plate 12 before the plate 12 is mounted to the outer rim 10, i.e., the strings S may be formed as a part of the plate unit UF. In this case, the strings S are loosely arranged in the plate, and stretched with the predetermined tensile force after the plate unit UF is mounted.

6. Keybed Unit Mounting Step

Figure 12:
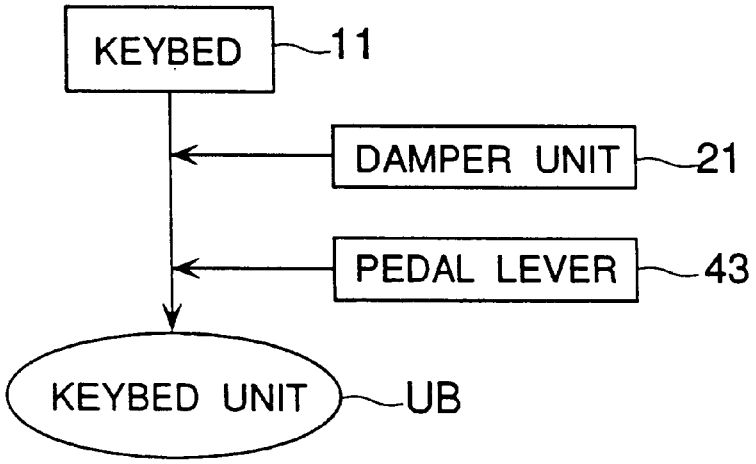
FIG. 12 is a flow diagram illustrating the structure of a keybed unit and an assembling procedure.
Figure 13:
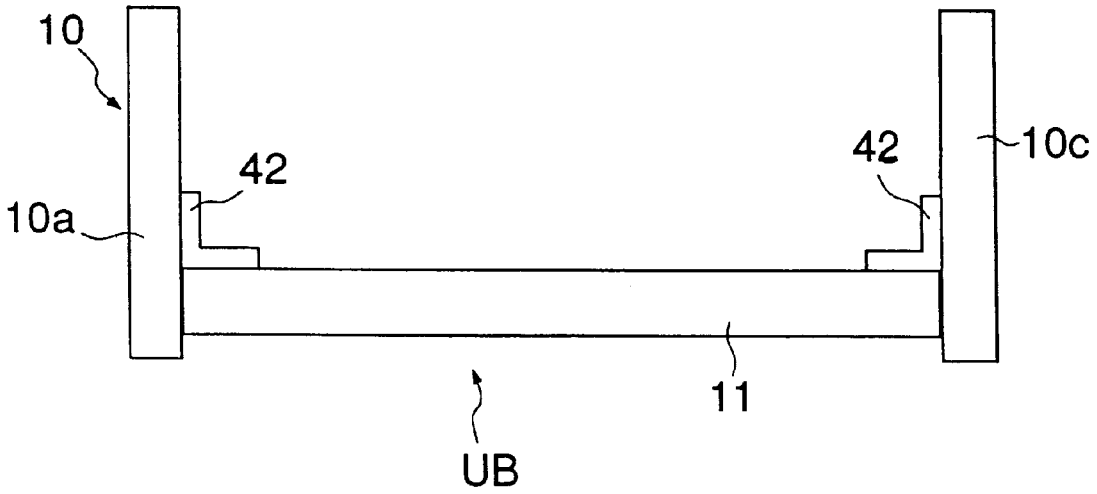
FIG. 13 is a front view illustrating how the keybed unit is mounted to the outer rim.

Next, the keybed unit UB is mounted to the flat plate 10*a* of the outer rim 10 through a keybed base 42. As illustrated in FIG. 12, this keybed unit UB is composed of the keybed 11, a damper unit 21 mounted on the top surface of the keybed 11, and a pedal lever 43 mounted on the rear surface of the same. The keybed base 42, which comprises a pair of left and right L-shaped fittings, for example, made of a metal, is positioned at a predetermined height position based on a height reference position provided by the top surface of the outer rim 10 and secured to the flat plate 10*a* with screws, as illustrated in FIG. 13. The keybed 11 is arranged between the inner surfaces of the flat plates 10*a*, 10*a* of the outer rim 10 and secured to the rear surfaces of the lower sides of the keybed base 42.

In accordance with the foregoing structure, since the keybed 11 is mounted to the outer rim 10 after the strings S have been stretched in the plate 12, even if deformations such as bow and twist occur in the outer rim 10 or the like due to the tensile forces of the strings S, bad influence due to the deformations can be eliminated by mounting the keybed base to the deformed outer rim 10 at the predetermined height position. The height reference position for the keybed base 42, defined at the top surface of the outer rim 10, is common to the sound board base 33, and the keybed 11 is arranged between the inner surfaces of the outer rim 10, so that the keybed base 42 can be used to mount the keybed 11 on the outer rim 10 at an arbitrary position in the vertical direction as deformations in the outer rim 10 or the like are absorbed (released). It is therefore possible to accurately ensure a predetermined vertical bosom space by mounting the keybed 11 at a predetermined height position, consequently making it possible to eliminate the cutting of the keybed which has been conventionally performed using a large cutting machine or the like. Alternatively, the L-shaped fittings constituting the keybed base 42 may be replaced by, for example, wood block type ones, and the keybed 11 is mounted to the lower surfaces thereof such that the keybed base 42 may also function as an action crossbar.

7. Keyboard Unit Mounting Step

Figure 14:
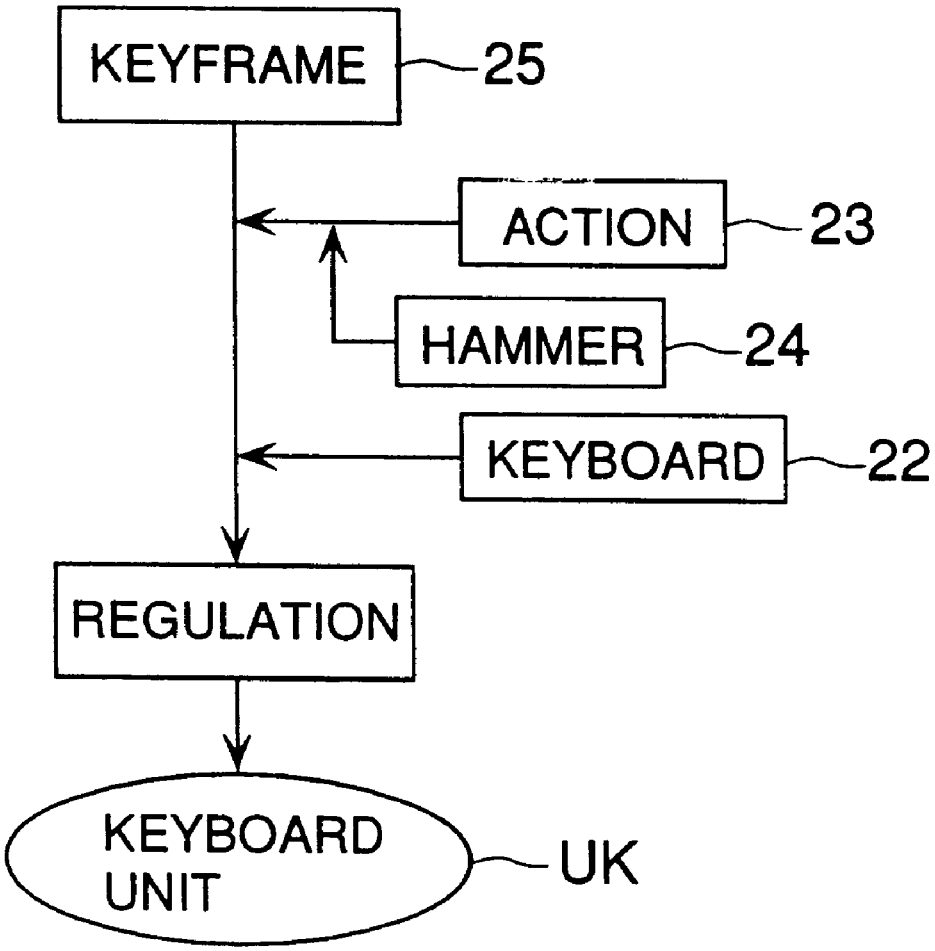
FIG. 14 is a flow diagram illustrating the structure of a keyboard unit and an assembling procedure.

Next, the keyboard unit UK is mounted to the keybed 11. As illustrated in FIG. 14, this keyboard unit UK is composed of a keyframe 25 carried on the keybed 11, a keyboard 22 mounted on the keyframe 25, and an action 23 with a hammer head 24, all of which have been completely adjusted. In accordance with this structure, previously completed regulation of the components except for the damper unit 21, in combination with the keybed 11 accurately positioned at the predetermined height, allows regulation after the unit is mounted to be easily made only with a slight adjustment.

Alternatively, the keybed unit UB and the keyboard unit UK may be configured as a single unit. Specifically, the damper unit 21, the keyframe 25, the keyboard 22, the action 23 and the hammer head 24 are mounted to the keybed 11, and the regulation of the components including he damper unit 21 may have been previously performed. This will further promote the formation of the components into a unit, and further facilitate the regulation after the unit is mounted.

8. Casing parts Mounting Step

Figure 17:
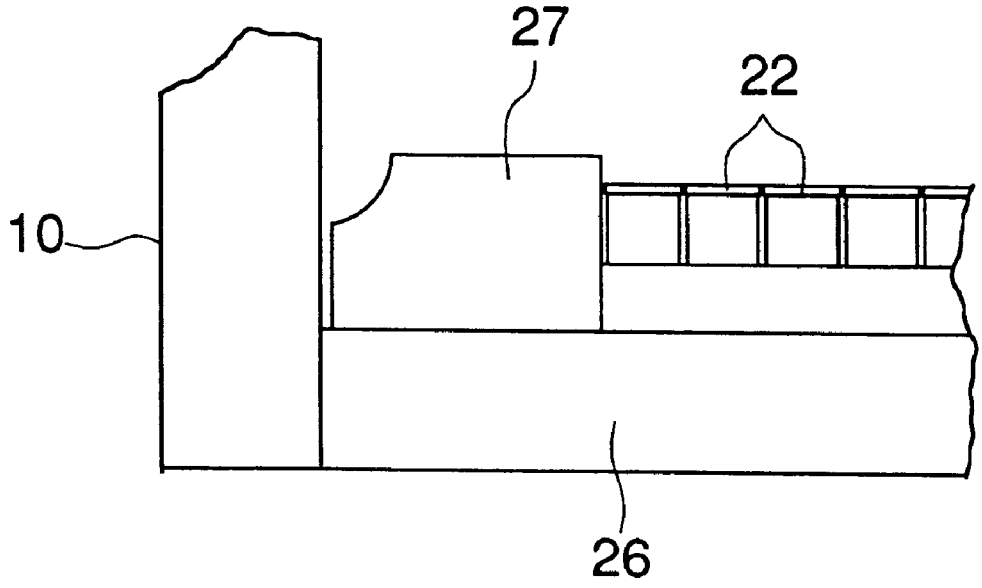
FIG. 17 is a front view of a cheekblock and its surroundings.

Next, casing parts 44 other than the outer rim 10, i.e., small parts such as the keyslip 26, cheekblock 27 and so on, a topboard rear 28 and a topboard front 29, and so on are mounted. In this event, as illustrated in FIG. 17, an upper corner potion of the cheekblock 27 proximal to the outer rim 10 is cut away in an arcuate shape. Even if this causes a gap between the outer rim 10 and the cheekblock 27 as illustrated in FIG. 17, this can be made less prominent. Since this effect allows the gap between the cheekblock 27 and the outer rim 10 to be tolerated to some degree, it is possible to omit a direct adjustment conventionally performed for eliminating the gap.

Here, a mounting structure of the keyslip 26 to the keybed 11 will be described in detail with reference to FIGS. 15 and 16.

Figure 15:
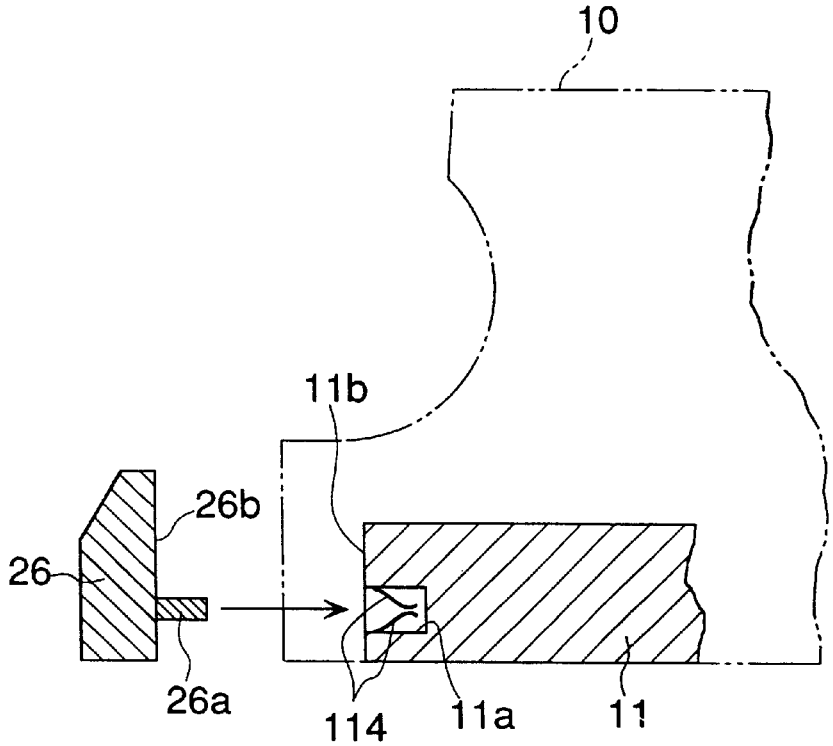
FIG. 15 are cross-sectional views illustrating a keyslip mounting portion in a keybed, where (a) illustrates the keybed before the keyslip is attached, and (b) illustrates the keybed after it is attached.
Figure 15:
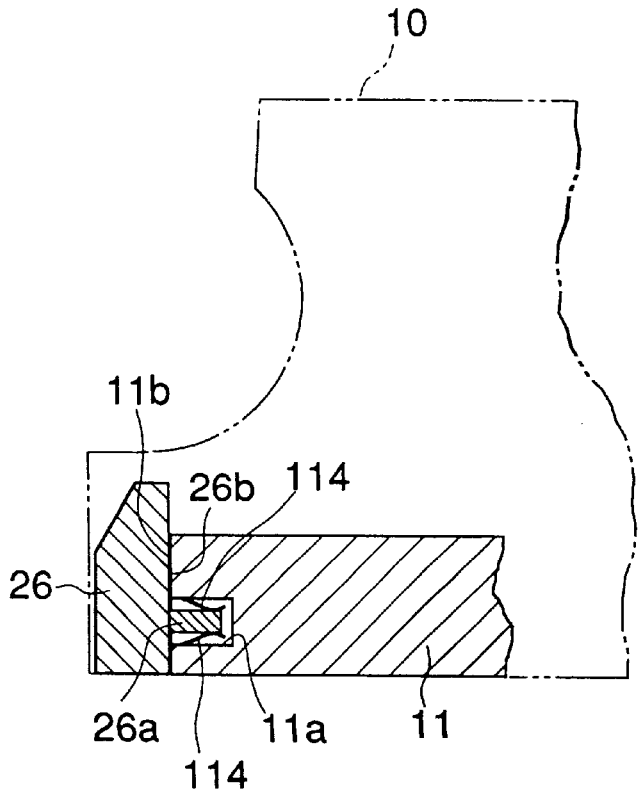

FIG. 15 are cross-sectional views illustrating a keyslip mounting portion in a keybed of a grand piano, where (a) illustrates a state before the keyslip is mounted, and (b) a state after it is mounted. As illustrated in this FIG. 15(*a*), on a back surface 26*b* of the keyslip 26, dowels 26*a* are arranged normal to the surface. The dowels 26*a* are provided at least one at each of the two longitudinal end portions of the keyslip 26. On the other hand, in the front surface 11*b* of the keybed 11 positioned below the outer rim 10 of the grand piano, inserting holes 11*a* are provided for inserting the dowels 26*a* of the keyslip 26 thereinto. Incidentally, the inserting hole 11*a* is formed sufficiently larger than the size of the dowel 26*a*. Also, the inserting hole 11*a* is provided therein with a receiving fitting 114 for sandwiching the dowel 26*a* when it is inserted thereinto. The receiving fitting 114 may be formed of, for example, a leaf spring or the like.

When the keyslip 26 formed as described above is mounted to the keybed 11, the keyslip 26 is moved in a direction indicated by an arrow to insert the dowel 26*a* of the keyslip 26 into the inserting hole 11*a* of the keybed 11, so that the back surface 26*b* of the keyslip 26 abuts to the front surface 11*b* of the keybed 11, as illustrated in FIG. 15(*a*). By thus mounting the keyslip 26 to the keybed 11, the mounting can be easily achieved.

Figure 26:
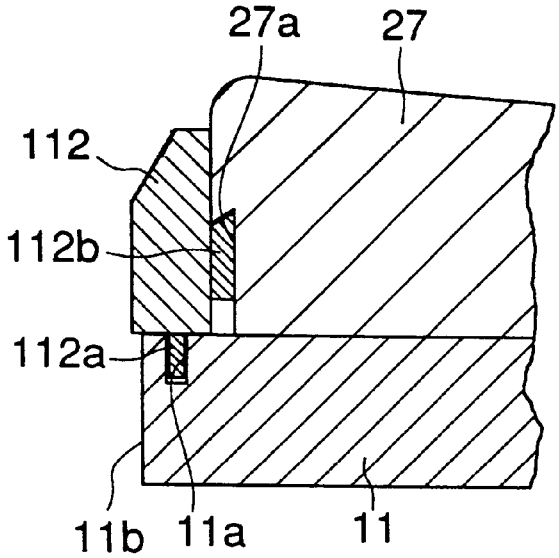
F I G. 2 6 PRIOR ART
FIG. 26 is a cross-sectional view illustrating a keyslip mounting portion of a keybed in a conventional keyboard musical instrument.
Figure 27:
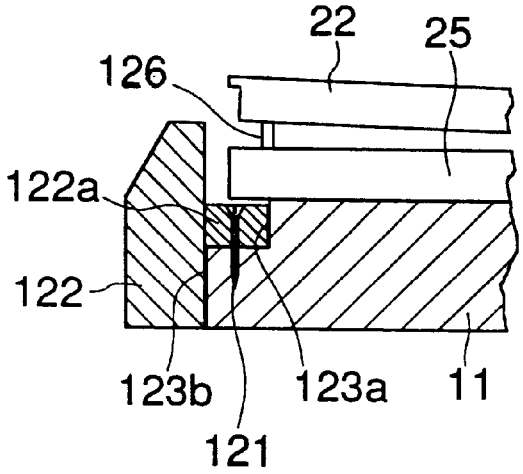
F I G. 2 7 PRIOR ART
FIG. 27 is a cross-sectional view illustrating a keyslip mounting portion of a keybed in another conventional keyboard musical instrument.

On the other hand, when the keyslip 26 is removed from the keybed 11, the keyslip 26 may be moved in the direction opposite to that indicated by the arrow in FIG. 15(*a*) to easily remove the keyslip 26 from the keybed 11 without removing the cheekblock 27 or the keyframe 25 and so on as before (see FIG. 26 and FIG. 27). In this way, adjustments of the keyboard, the action, and so on of the keyboard musical instrument can be efficiently performed as compared with a conventional keyboard musical instrument.

Further, in this embodiment, since the keyslip 26 is mounted to the front surface 11*b* of the keybed 11, attachment of a decorative plate on the front surface 11*b* of the keybed 11 and painting, as have been conventionally performed, are riot required, thereby making it possible to reduce the manufacturing cost and simplify the assembling steps.

Next, modified examples of this embodiment will be described. FIGS. 16(*a*), 16(*b*) are cross-sectional views respectively illustrating a modified example of the keyslip mounting portion in the keybed. As illustrated in FIG. 16(*a*), a piece of receiving fitting 115, bent in a ^-shape is arranged in the inserting hole 11*a* of the keybed 11. When the keyslip 26 is mounted to the keybed 11 of this type, the dowel 26*a* of the keyslip 26 is inserted into the inserting hole 11*a* of the keybed 11, in a manner similar to the aforementioned embodiment. This causes the receiving fitting 115 and the side surface within the inserting hole 11*a* to sandwich the dowel 26*a* therebetween, thereby producing similar effects to the aforementioned first embodiment.

Figure 16:
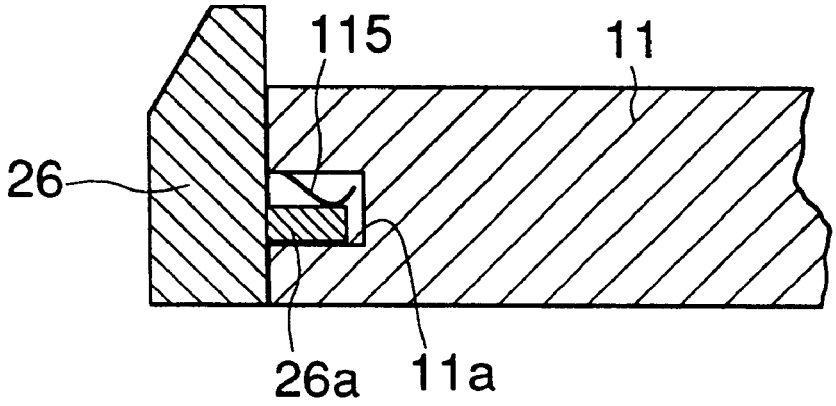
FIGS. 16(*a*) and (*b*) are cross-sectional views respectively illustrating a modification example of the keyslip mounting portion in the keybed.
Figure 16:
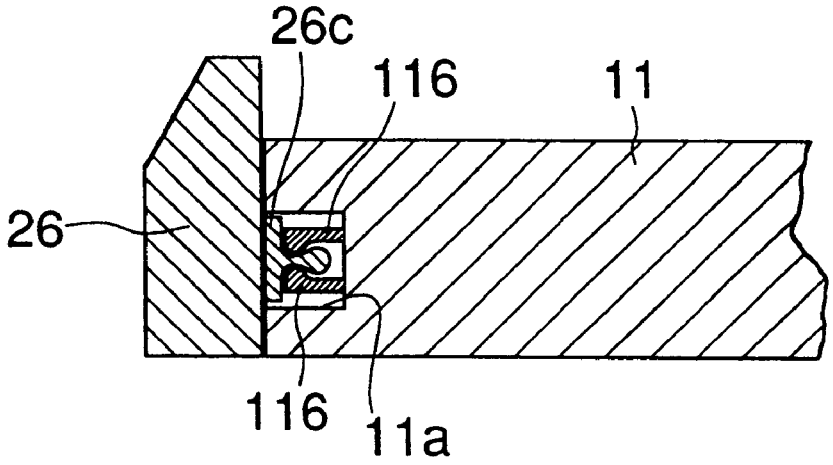

In the other modified example, a recessed fitting 6 made of an elastic material such as rubber, by way of example, is arranged within the inserting hole 11*a* of the keybed 11, as illustrated in FIG. 16(*b*). When the keyslip 26 is mounted to the keybed 11, a protrusion 2*c* formed on the back surface of the keyslip 26 is inserted into the inserting hole 11*a* of the keybed 11. This causes the tip of the protrusion 2*c* to mate with the fitting 6 within the inserting hole 11*a*, thereby producing similar effects to the aforementioned embodiment.

9. Finishing Step

Finally, the assembly of the grand piano is completed after finished sound tuning is performed, and testing such as external appearance check and so on is passed.

As described above, according to the method of assembling the grand piano of this embodiment, the outer rim 10 is positioned as a base such that other parts are mounted to the outer rim 10 in order, and the outer rim 10 is composed of three segments, thus making it possible to provide improved handling easiness during the assembly, simplification of operations in general, and reduction in machine and facility scales. Also, since principal parts to be mounted to the outer rim 10 are provided in the form of unit such as the sound board unit US, the plate unit UF, the keybed unit UB and the keyboard unit UK, the assembling steps can be significantly improved in efficiency by previously assembling these units separately from and independently of the outer rim 10.

Figure 21:
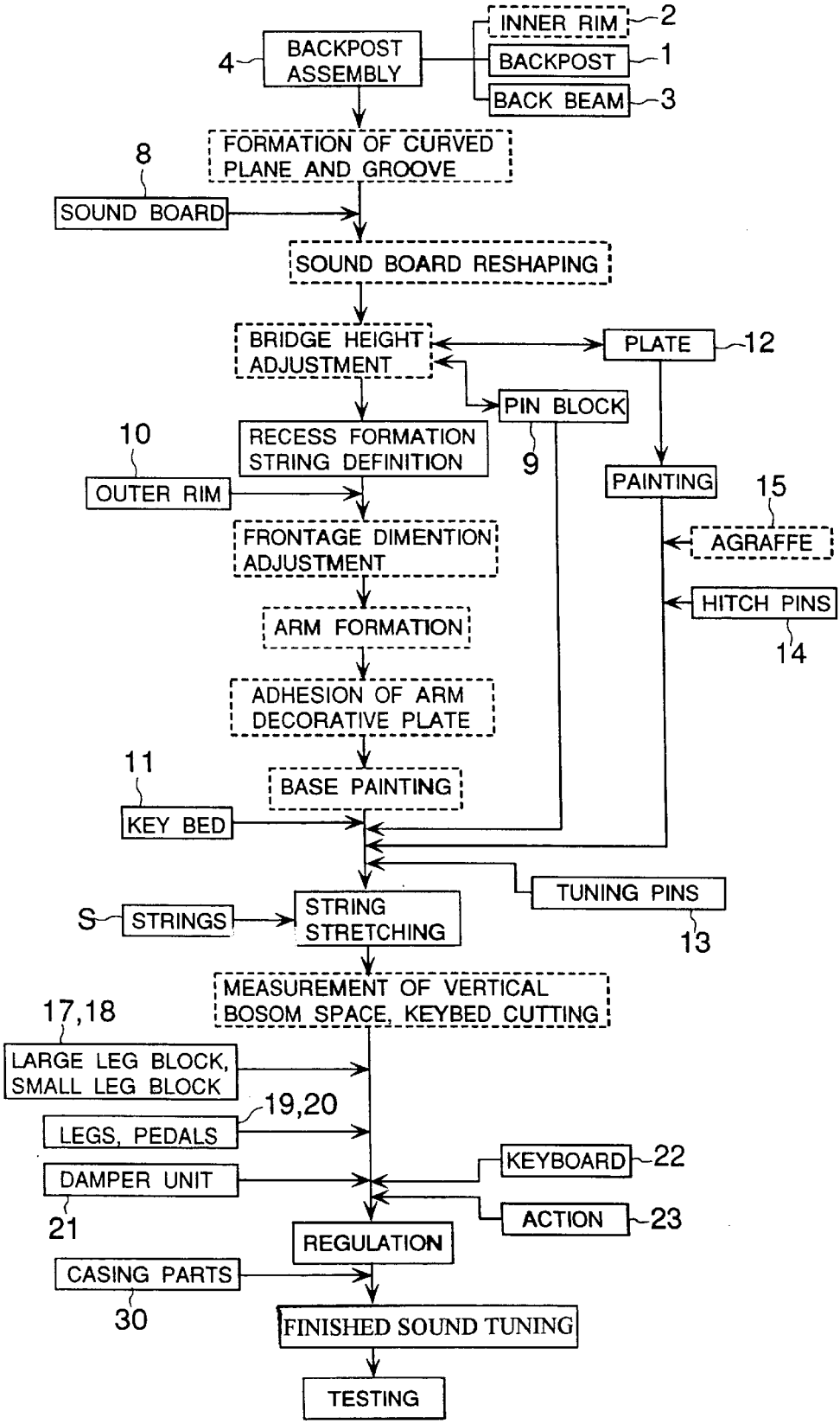
FIG. 21 PRIOR ART
FIG. 21 is a flow diagram illustrating a conventional method of assembling a grand piano.
Figure 22:
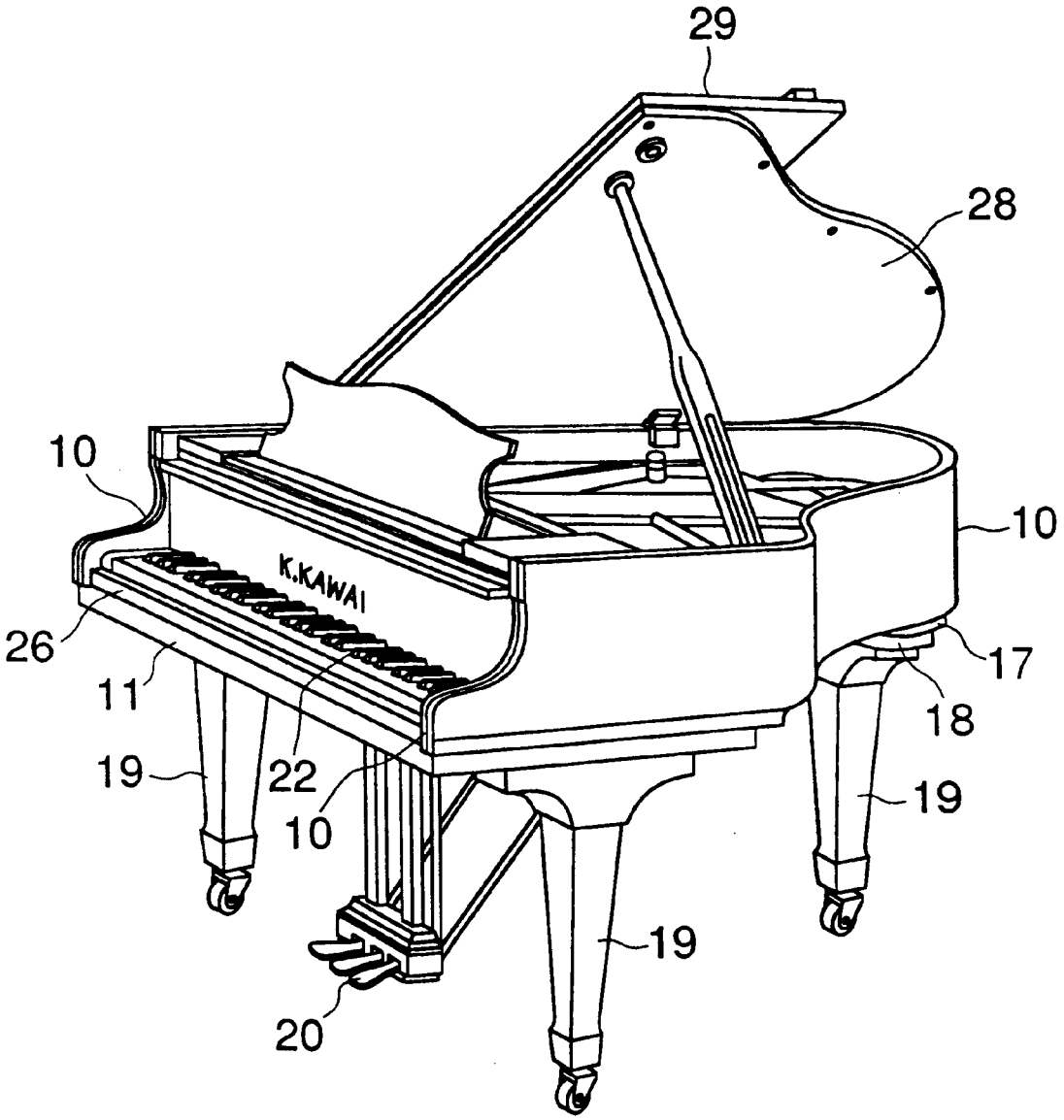
FIG. 22 PRIOR ART
FIG. 22 is a perspective view illustrating an external appearance of a conventional piano.
Figure 23:
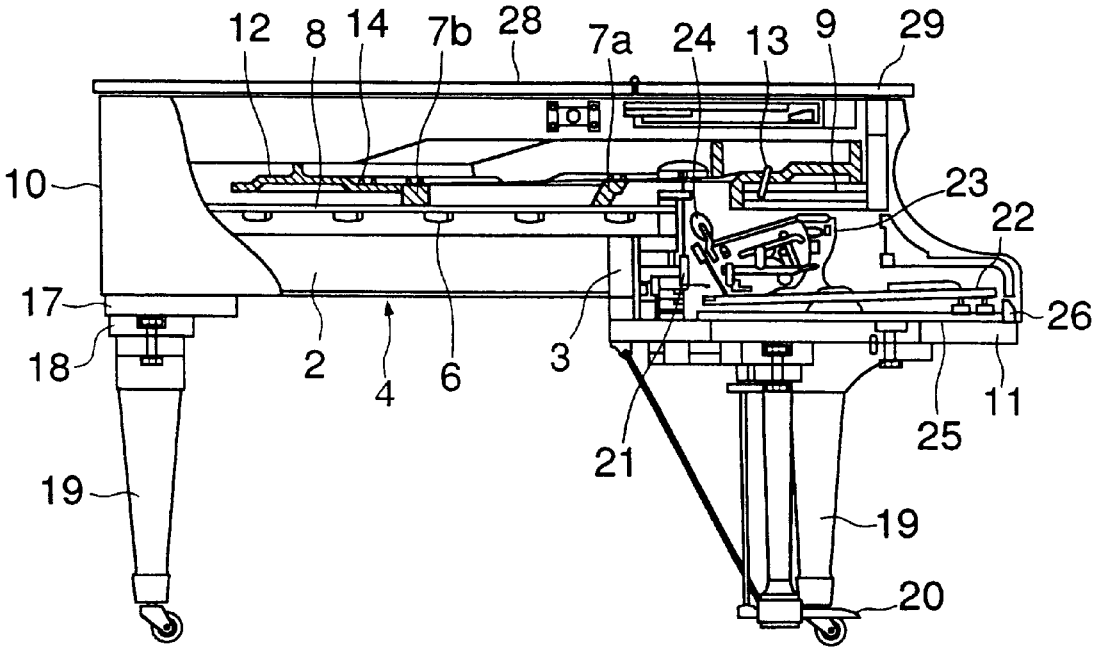
F I G. 2 3 PRIOR ART
FIG. 23 is a lateral sectional view of the conventional piano.
Figure 24:
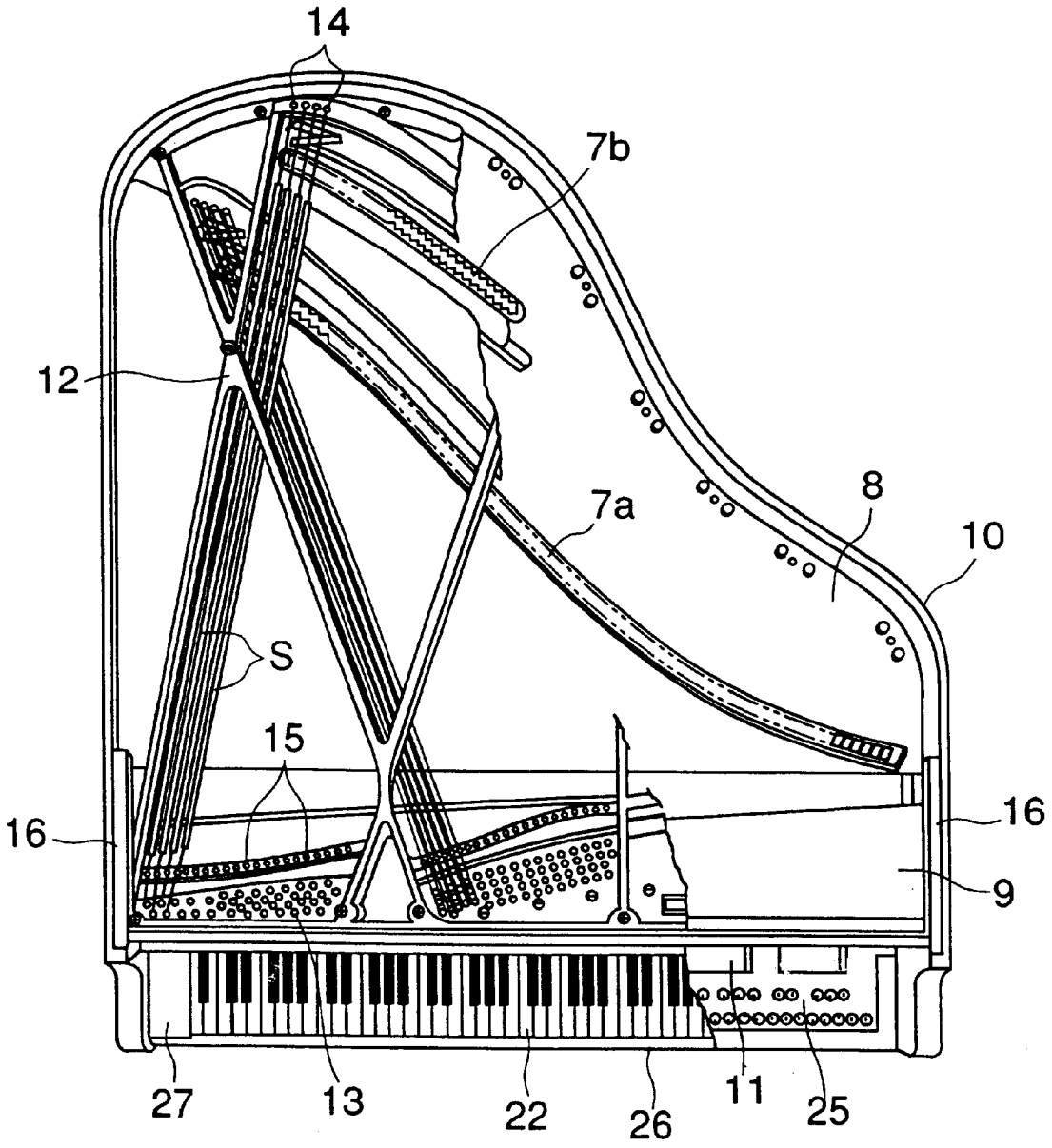
FIG. 24 PRIOR ART
FIG. 24 is a plan view illustrating the conventional piano.
Figure 25:
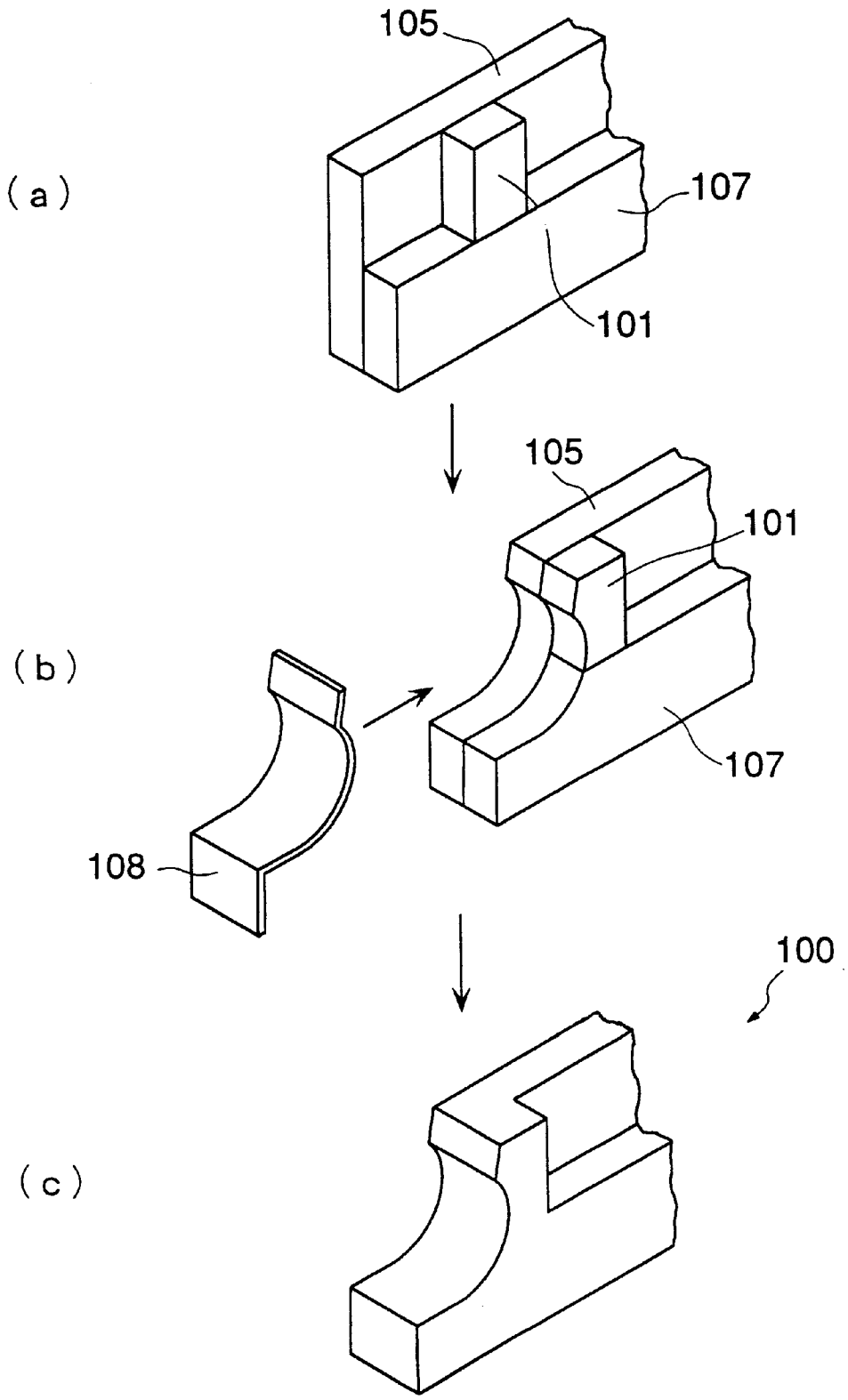
FIG. 25 PRIOR ART
FIG. 25 is an explanatory diagram of a conventional arm and a fabricating method thereof.

Also, within the conventional steps and parts illustrated in FIG. 21, those surrounded by broken lines are eliminated or largely simplified by the assembling method according to this embodiment. It is therefore possible, according to the assembling method of this embodiment, to realize significant simplification of the assembling steps and parts as compared with the conventional assembling method.

Next, a second embodiment of the present invention will be described with reference to FIGS. 18, 19. This embodiment differs from the first embodiment in the outer rim and a manufacturing method thereof. Since other aspects are identical, description thereon will be omitted.

Figure 18:
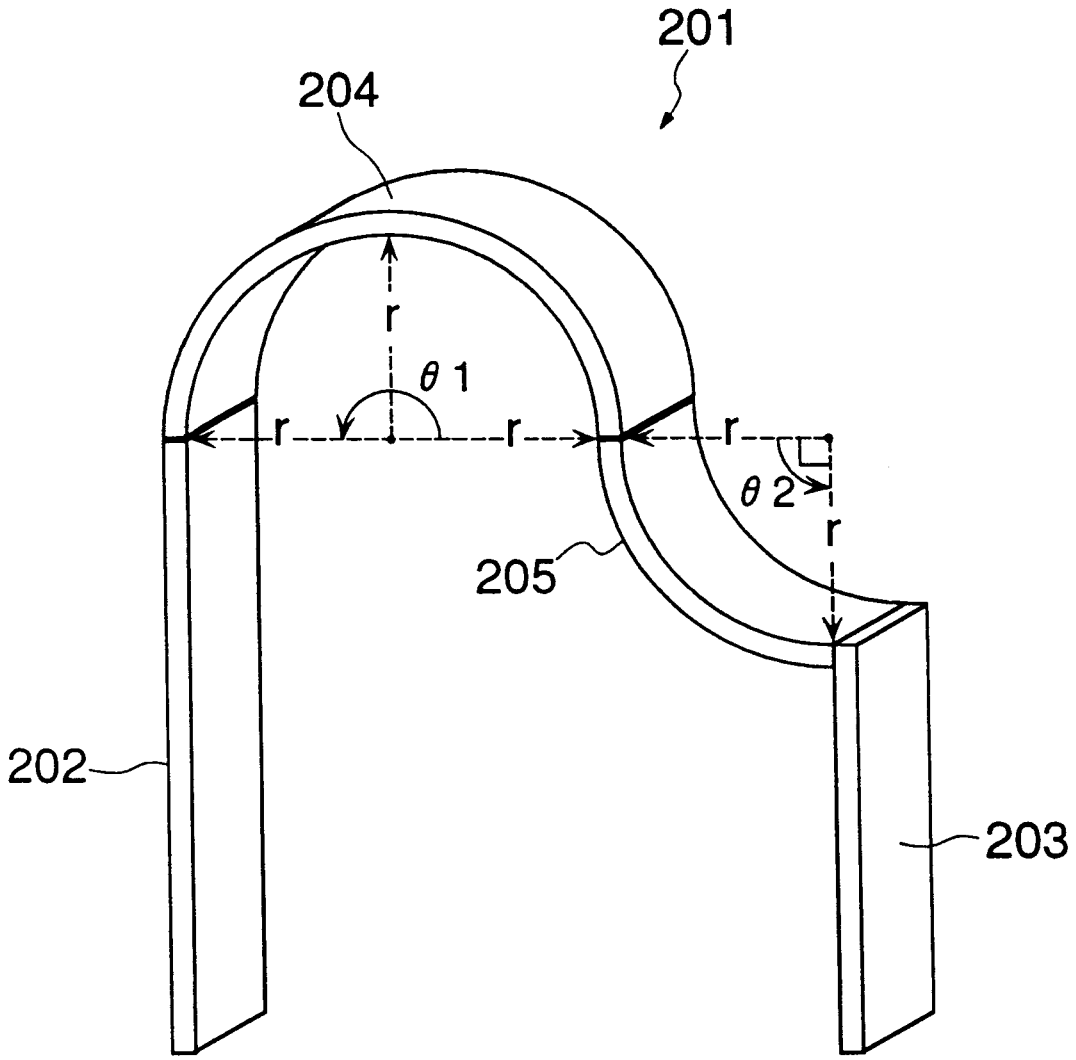
FIG. 18 is a perspective view illustrating an outer rim according to a second embodiment of the present invention.

As illustrated in FIG. 18, this outer rim 210 is composed of a left flat plate 202 forming a left front linear portion of a grand piano, a right flat plate 203 forming a right front linear portion, and two arcuate plates 204, 205 joining respective rear ends of the let flat plate 202 and the right flat plate 203 and forming a curved portion therebetween. These components are all made of off-the-shelf laminated plates each being approximately 4 mm in thickness and having approximately 15 layers of lauan plywood of approximately 30 cm in width and decorative single plates of birch or makore laminated on top and rear surfaces of laminated lauan plywood. This outer rim 210 is manufactured by the following manufacturing steps (1")–(4").

(1") Left Flat Plate Manufacturing Step

The left flat plate 202 is manufactured in a predetermined length, for example, a length of 150 cm by finishing end surfaces and surfaces of an off-the-shelf flat laminated plate and subsequently painting the surfaces by flow coating. This flow coating is performed using a painting machine such as a flow coater. In this event, the left flat plate 202 is carried by a conveyer or the like and passed through a paint curtain of a paint having a high flow-out. Then, the applied paint is dried by ultraviolet rays or the like and instantaneously hardened, so that the painting step can be completed in a short time.

(2") Right Flat Plate Manufacturing Step

The right flat plate 203 is processed and manufactured to a predetermined length, for example, approximately 100 cm (a length calculated by subtracting a radius r, later described, from the length of the let flat plate 202, i.e., 150 cm) by processing similar to the left flat plate 202 of the above ①. This step is performed independently of and in parallel with the above (1") step.

As described above, for the outer rim 210 of FIG. 18, general off-the-shelf flat laminated plates are used as the linear left flat plate and right flat plate to eliminate the conventional step of manufacturing a laminated plate from single plates (the single plate forming step and the pressing step), thereby making it possible to reduce the material cost and the processing cost. Also, since painting can be performed in a horizontally placed state, a paint having a high flow-out can be used. This enables thin and even painting, so that a drying time can be reduced to make a painting period shorter. In addition, since a painting technique such as general flow coating using a flow coater can be used as mentioned above, a reduction in the number of steps and a shorter period can be achieved because of automation, so that a further reduction in the processing cost and a shorter fabricating period can be achieved.

(3") Arcuate Plate Manufacturing Step

As illustrated in FIG. 18, the arcuate plate 204 and the arcuate plate 205 are each formed of an arcuately curved plate having the same radius, for example, an inner radius r equal to 50 cm. The center angle is 180° for the arcuate plate 204 ($\theta 1$ in FIG. 18) and 90° for the arcuate plate 205 ($\theta 2$ in FIG. 18), by way of example, as illustrated. In this arcuate plate manufacturing step, as illustrated in FIG. 19, an off-the-shelf cylindrical material 210 or 211 having an inner diameter (2r) of 100 cm, for example, is divided in the circumferential direction to cut out the arcuate plate 204 and 5, their end surfaces and surfaces are finished and subsequently painted to manufacture both the arcuate plates 204, 205.

Figure 19:
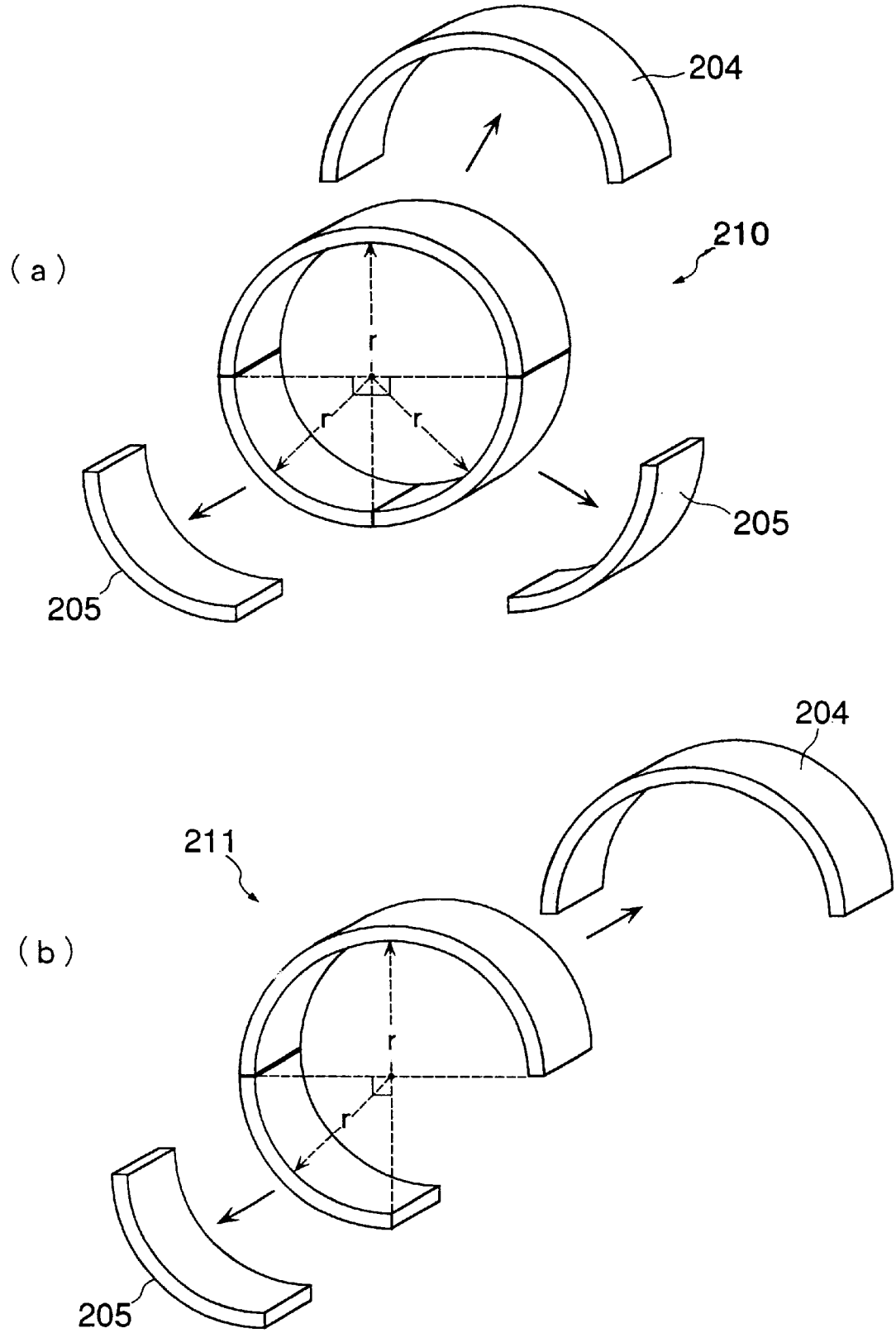
FIG. 19 is an explanatory diagram of a cylindrical material for an arcuate plate of FIG. 18.

For example, in the case of a completely cylindrical material 210 as illustrated in FIG. 19(*a*), four sets of the arcuate plates 204 and 5 can be manufactured if there are three materials 210. In the case of a material as in FIG. 19(*b*), one set of the same plates can be manufactured per one. Then, this arcuate plate manufacturing step is also performed independently of and in parallel with the aforementioned ① left flat plate manufacturing step and (2") right flat plate manufacturing step.

In the above described case, the arcuate plates 204 and 5 will have a length of approximately 160 cm or less and approximately 80 cm or less, respectively, and they are small as plates to be painted. For this reason, as a painting method, painting using a brush may also be possible other than a conventional painting method using a spray gun. Also, since the problem of a paint dropping down in course of painting occurs less frequently, a paint having a higher flow-out than before may be used to paint thin. Therefore, a drying time can be reduced, so that a painting period for repetitive painting can be made shorter.

Also, as described above, cylindrical materials marketed overseas or the like can be used to omit the conventional single plate forming step and pressing step, so that not only the processing period therefor can be omitted to reduce the entire manufacturing period, but also the material cost and the processing cost can be reduced. Furthermore, since the facility for generating vapor and facilities such as a pressing machine are not necessary, the facility cost can also be reduced.

Incidentally, even when the cylindrical material of FIG. 19 is manufactured as a laminated plate in a factory, a simple cylinder may only be formed in the single plate manufacturing step, so that processing by an expert is not required, automation is facilitated, a processing period can be reduced, and the processing cost can be reduced. Also, in the pressing step, the shapes of an outer mold and an inner mold of a used pressing machine are simple cylinders, and a pressure control during pressing becomes easier, so that a relatively inexpensive pressing machine may be used, so that the facility cost can be reduced.

(4") Joining Step

The respective members manufactured in the foregoing (1")–(3"), i.e., the left flat plate 202, the right flat plate 203, and the two arcuate plates 204, 205 are joined to each other through a hinge 34 and a reinforcing block (reinforcing material) 35, in a manner similar to that described in the first embodiment with reference to FIG. 5, to provide an outer rim 210 having a total length of approximately 5 m or less for a grand piano having a frontage dimension of approximately 150 cm and a depth dimension of approximately 200 cm.

As described in the first embodiment, during the manufacturing steps of a grand piano, processing and formation of the arm 32, adhesion and securing with screws of the sound board base 33 to the respective inner surfaces of the flat plates and the arcuate plates are actually performed prior to this (4") joining step, and thereafter the joining is performed.

Alternatively, the outer rim manufactured by this method may be mounted to the outer periphery of the inner rim after the joining step in the conventional method of manufacturing a grand piano.

As described above, the outer rim 210 of this embodiment is assembled by joining the respective members, i.e., the let flat plate 202, the right flat plate 203, and the two (a plurality of) arcuate plates 204, 205. In this way, the respective members can be independently handled until immediately before they are joined, unlike the case of an integrally formed outer rim. Specifically, after the aforementioned (1") left flat plate manufacturing step, (2") right flat plate manufacturing step, and (3") arcuate plate manufacturing step are performed independently of and in parallel with each other, (4") joining step can be performed, so that the entire manufacturing period can be reduced. Also, by performing up to painting before the respective members are joined, the painting and drying during the painting step may also be performed in parallel, thereby making it possible to further reduce the entire manufacturing period.

Also, since each member can be separately manufactured, each object to be processed is small and easy to handle in the manufacturing steps. Further, since each manufacturing step requires a less space, a smaller area is only required as the entire factory, and the facility cost and operation cost can be reduced. Further, when a material is pressed in the factory, a large pressing machine is not required, and a small and simple cylindrical pressing machine can serve, so that the facility cost can be further reduced.

Figure 20:
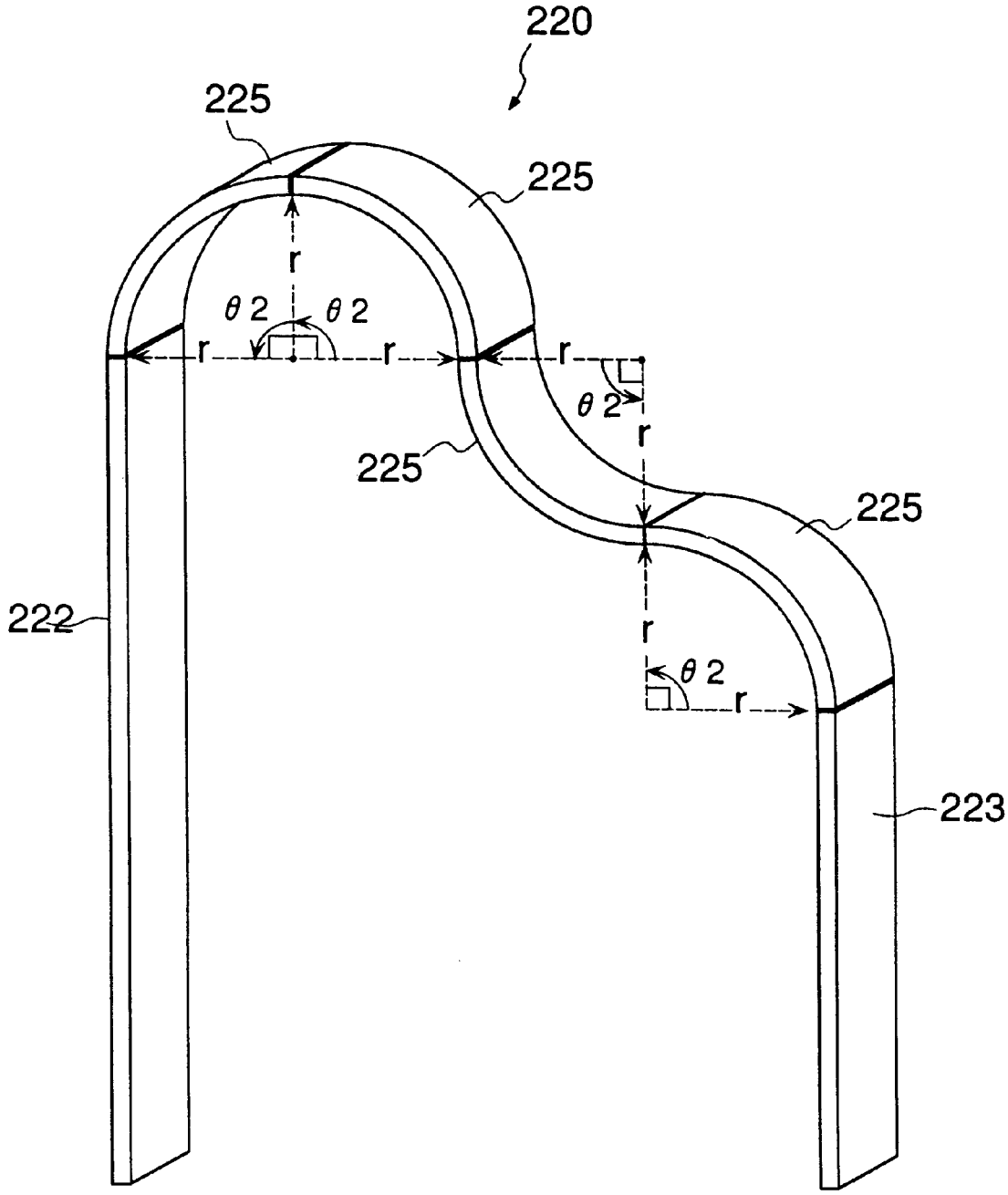
FIG. 20 is a perspective view illustrating an outer rim according to a third embodiment of the present invention.

FIG. 20 illustrates another example of an outer rim for a grand piano according to the present invention. This outer rim 220 is composed of four arcuate plates of a predetermined radius, for example, arcuate plates 225 having an inner diameter r equal to 40 cm and a center angle of 90° (θ2), and two flat plates of respective predetermined lengths, for example, a left flat plate 222 of 200 cm and a right flat plate 223 of 120 cm. The outer rim 220 is manufactured by equally dividing a cylindrical material having an inner diameter (2r=) equal to 80 cm (similar to FIG. 19(*a*)) into four in the circumferential direction. Other parts are manufactured in a similar way to the outer rim 210 in FIG. 18. Then, similar to the aforementioned first embodiment, or when it is used in a conventional method of assembling a grand piano, the outer rim 220 is mounted to the outer periphery of an inner rim after the joining step, resulting in the outer rim 220 having a total length of approximately 6 meters or less for a grand piano having a frontage dimension of approximately 160 cm and a depth dimension of approximately 240 cm.

This outer rim 220 has a general dimension slightly larger than the outer rim 210 in FIG. 18. The right flat plate 223 and the arcuate plate 225 draw a smooth curve near the joining portions thereof, thus presenting a more united configuration. Further, since the arcuate plate 225 can be manufactured for four units by equally dividing a single cylindrical material into four, it can be manufactured more easily, i.e., in a larger volume at a lower cost.

In addition, the present invention may be implemented in a variety of aspects without limited to the foregoing second embodiment.

For example, while the outer rim 210 in FIG. 18 and the outer rim 220 in FIG. 20 are made up of two and four (a plurality of) arcuate plates for facilitating the understanding, together with additional simple numeral values employed for the dimensions of the respective members, these numbers and dimensions may be changed as required for adapting to the shape and dimension of a particular grand piano. Specifically, while the arcuate plates 204, 205 in FIG. 18 and the arcuate plate 225 in FIG. 20 have simple center angles such as 180° and 90°, arcuate plates having a variety of center angles may be combined to form a more smooth and esthetics curved portion. In addition, arcuate plates of larger radii may be employed to realize more subtle curves, or a number of arcuate plates having small radii may be combined to present more complicated curves.

In the conventional method of assembling a grand piano using an inner rim, the left flat plate, the right flat plate, and a plurality of arcuate plates are joined to provide a complete outer rim before it is mounted to the inner rim in (4") Joining Step. Alternatively, the respective members may be separately mounted to the inner rim to constitute, as a result, an outer rim as illustrated in FIG. 18 or FIG. 20. In this case, since they can be handled as small members until they are joined to the inner rim, they can be joined to the inner rim more easily.

The present invention is not limited to the embodiment described above but may be implemented in a variety of aspects, and specific methods of the respective illustrated steps, materials of used parts, numbers and shapes thereof, and so on may be modified as required without departing from the spirit of the present invention.

Industrial Utilization Availability

As described above, the method of assembling a grand piano according to the present invention can provide significant simplification and improved efficiency in the assembling steps, thereby significantly reducing the assembling cost.

Also, according to the outer rim of a grand piano and the manufacturing method thereof of the present invention, a manufacturing period can be reduced, and the cost can be reduced in terms of material, processing, facilities and so on.

Further, according to the arm for a grand piano and the manufacturing method thereof of the present invention, the arm can be easily fabricated, resulting in a reduction in cost in terms of processing and facilities as well as a shorter fabricating period.

Furthermore, according to the present invention, in a keyboard musical instrument such as a grand piano, a keyslip is formed with protrusions on its back surface, while a keybed, to which the keyslip is mounted, is formed in its front surface with inserting holes for inserting the protrusions thereinto, so that the keyslip can be easily mounted to and removed from the keybed without dismounting a cheekblock or a keyframe. For this reason, a keyboard, an action and so on can be more efficiently adjusted as compared with the prior art.

What is claimed is:

1. A method of assembling a grand piano comprising:

forming an outer rim of the piano;

mounting a plurality of sound board bases to an inner surface of said outer rim;

mounting a sound board unit including a sound plate to said plurality of sound board bases mounted to said inner surface of said rim; and performing additional assembling steps to thereby assemble the piano.

2. A method of assembling a grand piano according to claim 1, wherein forming said outer rim comprises:

an outer rim member forming step of individually forming a plurality of outer rim members, respectively; and an outer rim member joining step of joining said plurality of formed outer rim members to each other.

3. A method of assembling a grand piano according to claim 2, wherein said outer rim member forming step comprises an outer rim member painting step of painting said plurality of outer rim members, respectively.

4. A method of assembling a grand piano according to claim 2, wherein said plurality of outer rim members are composed of two flat plates constituting front left and right linear portions of said outer rim and a curved plate constituting a remaining portion of said outer rim.

5. A method of assembling a grand piano according to claim 1, wherein a predetermined incline is previously formed on each top surface of said sound board bases, so that said sound board unit is fixed to said sound board bases in a state in which said sound plate is carried on said incline.

6. A method of assembling a grand piano according to claim 1, wherein a reinforcing material is attached on an inner surface of said outer rim.

7. A method of assembling a grand piano according to claim 1, wherein said sound plate of said sound board unit is made of plywood.

8. A method of assembling a grand piano according to claim 1, wherein said sound board unit comprises a bridge and a sound rib mounted on front and rear surfaces of said sound plate, respectively, and said bridge has undergone recess formation and string definition.

9. A method of assembling a grand piano according to claim 1, wherein said additional assembling steps comprise fixing a plate unit including a plate to said sound board unit in a state in which said plate is carried on said sound board unit after mounting said sound board unit.

10. A method of assembling a grand piano according to claim 9, wherein said plate unit comprises a pin block directly mounted to said plate.

11. A method of assembling a grand piano according to claim 10, wherein a tuning pin is embedded in said pin block of said plate unit.

12. A method of assembling a grand piano according to claim 9, comprising adjusting a bridge height by adjusting a vertical relative distance of said plate to said sound plate by way of a nose bolt.

13. A method of assembling a grand piano according to claim 9, wherein said additional assembling steps comprise stretching strings in said plate, subsequently fixing a keybed base to an inner surface of said outer rim, and mounting a keybed unit including a keybed to said outer rim through said keybed base after fixing said plate unit to said sound board unit.

14. A method of assembling a grand piano according to claim 13, wherein said keybed base and said sound board bases are mounted at respective predetermined height positions based on the same height reference position of said outer rim.

15. A method of assembling a grand piano according to claim 14, wherein said height reference position is set at a top surface of said outer rim, and said keybed is arranged between inner surfaces of said outer rim.

16. A method of assembling a grand piano according to claim 13, wherein said keybed unit comprises a damper unit mounted to said keybed.

17. A method of assembling a grand piano according to claim 13, wherein said keybed unit comprises a keyframe carried on said keybed, a keyboard mounted on said keyframe, an action, and a hammer head.

18. A method of assembling a grand piano according to claim 13, wherein said additional assembling steps further comprise a keyboard unit mounting step of mounting a keyboard unit including a keyboard to said keybed after mounting said keybed unit.

19. A method of assembling a grand piano according to claim 18, wherein said keybed unit comprises a keyframe carried on said keybed, a keyboard mounted on said keyframe, an action, and a hammer head.

* * * * *